US011097894B2

(12) United States Patent
Ophardt

(10) Patent No.: US 11,097,894 B2
(45) Date of Patent: Aug. 24, 2021

(54) KNEE OPERATED AND/OR MOTOR OPERATED WASTE BIN

(71) Applicant: OP-Hygiene IP GmbH, Niederbipp (CH)

(72) Inventor: Heiner Ophardt, Arisdorf (CH)

(73) Assignee: OP-Hygiene IP GmbH, Niederbipp (CH)

( * ) Notice: Subject to any disclaimer, the term of this patent is extended or adjusted under 35 U.S.C. 154(b) by 264 days.

(21) Appl. No.: 16/285,801

(22) Filed: Feb. 26, 2019

(65) Prior Publication Data

US 2020/0270056 A1 Aug. 27, 2020

(30) Foreign Application Priority Data

Feb. 27, 2018 (CA) ..... CA 2996830

(51) Int. Cl.
*B65F 1/16* (2006.01)

(52) U.S. Cl.
CPC ..... *B65F 1/1638* (2013.01); *B65F 2210/168* (2013.01); *B65F 2210/172* (2013.01)

(58) Field of Classification Search
CPC .. B65F 1/1638; B65F 1/00; B65F 1/14; B65F 1/16; B65F 1/1421; B65F 1/1431; B65F 1/002; B65F 1/10; B65F 1/1442; B65F 1/1623; B65F 1/163; B65F 2230/15; B65F 2001/1653; B65F 2001/1669; B65D 2210/168; B65D 2210/172; B65D 43/16; B65D 43/163; B65D 43/18; B65D 43/26;
(Continued)

(56) References Cited

U.S. PATENT DOCUMENTS

2001/0045512 A1* 11/2001 Brent ..... B65F 1/1638 250/221
2014/0184110 A1* 7/2014 Wang ..... H02P 1/02 318/139

(Continued)

FOREIGN PATENT DOCUMENTS

| | | |
|---|---|---|
| DE | 3516440 | 11/1986 |
| DE | 4101285 | 7/1992 |
| GB | 1296541 | 11/1972 |

OTHER PUBLICATIONS

Plastic Waste Bin—MAXI-WALLY—from website: http://www.medicalexpo.com/prod/francehopital/product-68519-571899.html dated Jul. 12, 2017.

(Continued)

*Primary Examiner* — Don M Anderson
(74) *Attorney, Agent, or Firm* — Thorpe North and Western LLP

(57) ABSTRACT

A container having a receptacle with an open upper end for receiving material, and an edge cap that is movably supported relative to the receptacle. The edge cap has a sidewall that is spaced outwardly from a camming surface of the receptacle, and a lid support member that projects inwardly from the sidewall. A lid panel is pivotably mounted to the lid support member for pivoting between a closed position and an open position. An actuation portion of the lid panel has a cam surface that is positioned between the camming surface and the sidewall. The cam surface is configured to engage with the camming surface to pivot the lid panel towards the open position when the sidewall is moved towards the camming surface.

20 Claims, 28 Drawing Sheets

(58) Field of Classification Search
CPC ... B65D 43/262; B65D 43/265; B65D 43/267
See application file for complete search history.

(56) References Cited

U.S. PATENT DOCUMENTS

2017/0320639 A1* 11/2017 Shek ..... B65D 43/26
2018/0110893 A1* 4/2018 Chang ..... B65F 1/1638

OTHER PUBLICATIONS

MAXI-WALLY photograph from website http://www.francehopital.com/en/products/86/3001/wally-kneeopening-bins dated Jun. 26, 2019.

* cited by examiner

KNEE OPERATED AND/OR MOTOR OPERATED WASTE BIN

FIELD OF THE INVENTION

This invention relates to containers, and more particularly to waste bins that have a knee operated and/or motor operated lid.

BACKGROUND OF THE INVENTION

Bins for depositing waste products, such as used paper towels, floor sweepings, food scraps, discarded packaging, and other recyclable, compostable, and/or disposable materials are known in the art. Often, waste bins are provided with a lid to keep in foul odors, to keep out animals, to prevent discarded materials from spilling out of the bin, and/or to maintain a pleasant aesthetic appearance. In order to deposit materials into these bins, the lid must be moved aside, or in some cases removed altogether, so as to provide access to the bin's inner chamber. This can be a cumbersome process, sometimes requiring the user to manually lift, remove, replace, push, pull and/or press the lid in order to gain access. This may require the user to set the waste material down while manipulating the lid, and/or the process may require both of the user's hands. As a consequence, the process may take longer than desired, and may interrupt other activities requiring the user's hands, such as answering a phone call or sending a text message. Lid opening mechanisms that require use of a user's hands also risk transmitting infectious agents between users, and could contaminate the user's hands with noxious waste chemicals and the like.

SUMMARY OF THE INVENTION

To at least partially overcome some of the disadvantages of previously known devices, the invention provides a container having a receptacle with an open upper end for receiving material, a movable sidewall that is spaced outwardly from the receptacle, and a lid panel that moves from a closed position to an open position when the sidewall is moved towards the receptacle. The inventors have appreciated that changes in the spacing between the sidewall and the receptacle can usefully be used to effect movement of the lid panel from the closed position to the open position through camming and/or other mechanical interactions.

For example, the lid panel can have a cam surface that is positioned between the receptacle and the sidewall, the cam surface being configured to engage with a camming surface of the receptacle to pivot the lid panel from the closed position to the open position when the sidewall is moved from a first location to a second location, the second location being closer to the receptacle than the first location. The inventors have appreciated that the open end of the receptacle can be easily and conveniently accessed by moving the sidewall from the first location to the second location, so that material can be deposited into the receptacle. For example, in some preferred embodiments, the lid panel can be handlessly opened by pressing a user's knee against the sidewall, leaving the user's hands available for other tasks.

The inventors have further appreciated that the container can be advantageously adapted for opening through numerous different mechanisms, thereby increasing choice and convenience for users. For example, in some embodiments the lid panel can also be pivoted from the closed position to the open position by manually depressing a cover portion of the lid panel, without moving the sidewall from the first location to the second location. The cam surface can be configured to be mechanically disengaged from the camming surface when the lid panel is in the open position and the sidewall is at the first location, to thereby allow the lid panel to be opened without requiring movement of the sidewall. This can be achieved, for example, by making the cam surface and the camming surface independently movable relative to one another, with no fixed mechanical connection between the two.

The container can also include a lifting assembly that is operable to lift an actuation portion of the lid panel when activated, to pivot the lid panel from the closed position to the open position without moving the sidewall from the first location to the second location. The lifting assembly can include, for example, an electric motor that is operable to move a lifting body, such as a pin, upwards to engage and lift the actuation portion of the lid panel when the motor is activated. The actuation portion can be configured to be mechanically disengaged from the lifting body when the lid panel is in the open position and the lifting assembly is inactive, to thereby allow the lid panel to be opened without requiring activation of the motor. This can be achieved, for example, by positioning the lifting body below the actuation portion, so that the actuation portion can sit on and be lifted by the lifting body, but is not mechanically fastened thereto.

The inventors have further appreciated that activation of the lifting assembly can be usefully triggered by shade that is cast by holding an object, such as an object that is to be deposited into the container, over the lid. The lid can, for example, include a solar panel that generates electricity from a light source, with the amount of electricity generated being reduced when shade is cast over the solar panel. A controller can be configured to activate the motor when the electricity generated by the solar panel is reduced by a predetermined extent. This provides a useful mechanism for opening the lid of the container without requiring any contact between the user and the container.

The sidewall can be incorporated into a shroud that surrounds the receptacle, and sits on a support surface, such as the floor, without being rigidly connected thereto. This allows the shroud to be tiltable towards the receptacle, to thereby move the sidewall from the first location to the second location. This simple mechanism for movably supporting the sidewall relative to the receptacle reduces the complexity of the container. It also allows the shroud to be removable from the receptacle, to thereby provide easy access to the receptacle for emptying its contents, such as by replacing a garbage bag held therein.

The shroud can furthermore incorporate additional sidewalls, such as a second sidewall, a third sidewall, and a fourth sidewall that are arranged together with the first sidewall in a generally rectangular shape surrounding the receptacle. Each sidewall can have an associated lid panel and lifting assembly, with each lid panel being movable from its closed position to its open position by tilting the corresponding sidewall towards the receptacle. This allows the open end of the receptacle to be easily accessed from every side of the container. Users are therefore able to approach and deposit material into the container from whichever side is most convenient, rather than having to operate the container exclusively from one particular location.

Accordingly, in one aspect the present invention resides in a container comprising:

a receptacle with an open upper end for receiving material, the receptacle comprising a camming surface;

an edge cap that is movably supported relative to the receptacle, the edge cap comprising a sidewall that is spaced outwardly from the camming surface, and a lid support member that projects inwardly from the sidewall, the sidewall being movable between a first location, in which the sidewall is spaced a first distance from the camming surface, and a second location, in which the sidewall is spaced a second distance from the camming surface, the first distance being greater than the second distance; and a lid panel that is pivotably mounted to the lid support member for pivoting about a horizontal axis, the lid panel comprising:

a cover portion that extends from the axis over the open end of the receptacle; and an actuation portion that extends from the axis towards the sidewall;

the lid panel being pivotable about the axis between a closed position, in which the cover portion at least partially covers the open end of the receptacle, and an open position, in which the actuation portion is pivoted upwards from the closed position and the cover portion is pivoted downwards from the closed position to provide access to the open end of the receptacle;

the actuation portion of the lid panel having a weight selected to bias the lid panel towards the closed position;

the actuation portion comprising a cam surface that is positioned between the camming surface and the sidewall, the cam surface being configured to engage with the camming surface to pivot the actuation portion of the lid panel upwards, towards the open position, when the sidewall is moved from the first location to the second location.

The sidewall may, for example, be configured to move from the first location to the second location upon application of a horizontal force to the sidewall. The sidewall may also be biased to return to the first location from the second location.

The cam surface may be configured to apply a biasing force, provided by the weight of the actuation portion of the lid panel, to the camming surface when the sidewall is at the second location, the biasing force biasing the sidewall towards the first location.

In some embodiments, the actuation portion of the lid panel further comprises a counterweight.

Preferably, the lid panel is pivotable from the closed position to the open position by manually depressing the cover portion of the lid panel, without moving the sidewall from the first location to the second location.

The cam surface may be configured to be mechanically disengaged from the camming surface when the lid panel is in the open position and the sidewall is at the first location.

In some embodiments, the container further comprises a lifting assembly that is operable to lift the actuation portion of the lid panel when activated, to pivot the lid panel from the closed position to the open position, without moving the sidewall from the first location to the second location;

the lifting assembly comprising a lifting body that is configured to engage and lift the actuation portion when the lifting assembly is activated and the sidewall is at the first location.

The actuation portion of the lid panel may be configured to be mechanically disengaged from the lifting body when the lid panel is in the open position and the lifting assembly is inactive.

Optionally, the lifting assembly further comprises a motor that is configured to move the lifting body upwards when activated. The motor may be battery powered. In some embodiments, the actuation portion of the lid panel further comprises a battery for powering the motor, the battery having a weight selected to bias the lid panel towards the closed position. The motor may also be solar powered.

The lifting assembly may, for example, further comprise a gear wheel that is rotatably mounted to the sidewall;

wherein the lifting body comprises a pin that extends from an inwardly facing surface of the gear wheel towards the receptacle;

wherein the motor is configured to rotate the gear wheel when activated; and wherein the pin is configured to lift the actuation portion of the lid panel when the gear wheel is rotated upon activation of the motor.

Optionally, the motor is mounted to the sidewall;

wherein the gear wheel comprises a worm wheel, and the lifting assembly further comprises a worm screw;

wherein the motor is configured to rotate the worm screw when activated; and wherein the worm screw is configured to engage with the worm wheel to effect rotation of the worm wheel upon activation of the motor.

The cover portion of the lid panel may comprise a solar panel that is configured to generate electricity from a light source;

wherein the electricity generated by the solar panel is reduced when an object is placed over the cover portion so as to cast shade on the solar panel;

wherein the lifting assembly further comprises a controller that is configured to control activation of the motor; and wherein the controller is configured to activate the motor when the electricity generated by the solar panel is reduced by a predetermined extent.

The solar panel may be configured to generate electricity for powering the motor.

In some embodiments, the receptacle comprises a bin, the bin having a bin wall with an outwardly facing surface; and wherein the outwardly facing surface of the bin wall comprises the camming surface.

The bin is preferably configured to be rigidly mounted to a floor surface.

In some embodiments, the sidewall is supported at a height, relative to the floor surface, that is selected to permit a user standing on the floor surface to move the sidewall from the first location to the second location by pressing a knee against the sidewall.

The container may further comprise a shroud with a hollow interior, the bin being disposed within the hollow interior;

wherein the shroud incorporates and supports the edge cap;

wherein the shroud is configured to sit on a support surface, without being rigidly secured to the support surface, so that the shroud is tiltable towards the outwardly facing surface of the bin wall; and wherein the sidewall is at the first location when the shroud is sitting squarely on the support surface, and is at the second location when the shroud is tilted at a predetermined angle towards the outwardly facing surface of the bin wall.

The support surface optionally comprises the floor surface. In other embodiments, the bin further comprises a support portion with an upwardly facing surface, the upwardly facing surface comprising the support surface.

The shroud is preferably removable from the bin. The edge cap is likewise preferably removable from the receptacle.

The camming surface may be a first camming surface, the bin further comprising a second camming surface, a third camming surface, and a fourth camming surface;

wherein the sidewall is a first sidewall and the lid support member is a first lid support member, the shroud further comprising:

a second sidewall that is spaced outwardly from the second camming surface;

a second lid support member that projects inwardly from the second sidewall;

a third sidewall that is spaced outwardly from the third camming surface;

a third lid support member that projects inwardly from the third sidewall;

a fourth sidewall that is spaced outwardly from the fourth camming surface; and a fourth lid support member that projects inwardly from the fourth sidewall;

wherein the lid panel is a first lid panel, the container further comprising:

a second lid panel that is pivotably mounted to the second lid support member for pivoting about a second horizontal axis, the second lid panel comprising:

a second cover portion that extends from the second axis over the open end of the receptacle; and a second actuation portion that extends from the second axis towards the second sidewall;

the second lid panel being pivotable about the second axis between a closed position, in which the second cover portion at least partially covers the open end of the receptacle, and an open position, in which the second actuation portion is pivoted upwards from the closed position and the second cover portion is pivoted downwards from the closed position to provide access to the open end of the receptacle;

the second actuation portion of the second lid panel having a weight selected to bias the second lid panel towards the closed position;

the second actuation portion comprising a second cam surface that is positioned between the second camming surface and the second sidewall, the second cam surface being configured to engage with the second camming surface to pivot the second actuation portion of the second lid panel upwards, towards the open position, when the shroud is tilted at the predetermined angle towards the second camming surface;

a third lid panel that is pivotably mounted to the third lid support member for pivoting about a third horizontal axis, the third lid panel comprising:

a third cover portion that extends from the third axis over the open end of the receptacle; and a third actuation portion that extends from the third axis towards the third sidewall;

the third lid panel being pivotable about the third axis between a closed position, in which the third cover portion at least partially covers the open end of the receptacle, and an open position, in which the third actuation portion is pivoted upwards from the closed position and the third cover portion is pivoted downwards from the closed position to provide access to the open end of the receptacle;

the third actuation portion of the third lid panel having a weight selected to bias the third lid panel towards the closed position;

the third actuation portion comprising a third cam surface that is positioned between the third camming surface and the third sidewall, the third cam surface being configured to engage with the third camming surface to pivot the third actuation portion of the third lid panel upwards, towards the open position, when the shroud is tilted at the predetermined angle towards the third camming surface; and a fourth lid panel that is pivotably mounted to the fourth lid support member for pivoting about a fourth horizontal axis, the fourth lid panel comprising:

a fourth cover portion that extends from the fourth axis over the open end of the receptacle; and a fourth actuation portion that extends from the fourth axis towards the fourth sidewall;

the fourth lid panel being pivotable about the fourth axis between a closed position, in which the fourth cover portion at least partially covers the open end of the receptacle, and an open position, in which the fourth actuation portion is pivoted upwards from the closed position and the fourth cover portion is pivoted downwards from the closed position to provide access to the open end of the receptacle;

the fourth actuation portion of the fourth lid panel having a weight selected to bias the fourth lid panel towards the closed position;

the fourth actuation portion comprising a fourth cam surface that is positioned between the fourth camming surface and the fourth sidewall, the fourth cam surface being configured to engage with the fourth camming surface to pivot the fourth actuation portion of the fourth lid panel upwards, towards the open position, when the shroud is tilted at the predetermined angle towards the fourth camming surface.

Optionally, the first sidewall, the first lid support member, the second sidewall, the second lid support member, the third sidewall, the third lid support member, the fourth sidewall, and the fourth lid support member together form a shroud head that surrounds the open end of the receptacle.

In some embodiments, the container is a waste container.

The lifting assembly may be configured to hold the lid panel in the open position for a predetermined time period when activated, and then to allow the lid panel to return to the closed position after the predetermined time period has ended.

In some embodiments, the movement of the sidewall from the first location to the second location comprises tilting the sidewall towards the camming surface.

In another aspect, the present invention resides in a container comprising:

a receptacle with an open upper end for receiving material;

a lid that is movably supported relative to the receptacle, the lid being movable between a closed condition, in which the lid at least partially covers the open end of the receptacle, and an open condition, in which the lid is moved so as to provide access to the open end of the receptacle; and a sidewall that is spaced from and movably supported relative to the receptacle, the sidewall being movable between a first position, in which the sidewall is spaced a first distance from the receptacle, and a second position, in which the sidewall is spaced a second distance from the receptacle, the first distance being greater than the second distance; and an actuation mechanism that is configured to effect movement of the lid from the closed condition to the open condition upon movement of the sidewall from the first position to the second position.

In some embodiments, the movement of the sidewall from the first position to the second position comprises tilting the sidewall towards the receptacle.

Optionally, the sidewall is a first sidewall, the container further comprising a second sidewall, a third sidewall, and a fourth sidewall;

wherein the first sidewall, the second sidewall, the third sidewall, and the fourth sidewall together form a shroud that encircles the receptacle, with the third sidewall being positioned at an opposite side of the shroud from the first sidewall;

wherein the first sidewall, the second sidewall, the third sidewall, and the fourth sidewall each have a bottom edge that is configured to sit squarely on a support surface adjacent to the receptacle when the first sidewall is at the first position;

wherein the movement of the first sidewall from the first position to the second position comprises pivoting the shroud about a horizontal pivot axis defined by the bottom edge of the third sidewall; and wherein the bottom edge of the first sidewall is spaced from the support surface and the bottom edge of the third sidewall is in contact with the support surface when the first sidewall is at the second position.

In a further aspect, the present invention resides in a shade-operated movable barrier comprising:

a blocking member that is movable between a closed position, in which the blocking member at least partially obstructs a passage, and an open position, in which the blocking member is moved to provide access to the passage;

a mechanical actuator that is configured to move the blocking member from the closed position to the open position upon activation;

a controller that is configured to control activation of the mechanical actuator; and a solar panel that is configured to generate electricity from a light source;

wherein the electricity generated by the solar panel is reduced when an object is placed over the solar panel so as to cast shade on the solar panel; and wherein the controller is configured to activate the mechanical actuator when the electricity generated by the solar panel is reduced by a predetermined extent amount.

Optionally, the blocking member comprises the solar panel.

The solar panel may be configured to generate electricity for powering the mechanical actuator.

The blocking member may, for example, comprise a lid for a container. The container is optionally a waste container. The passage may comprise an open upper end of the container.

Optionally, the lid is pivotable about a horizontal axis, the lid comprising:

a cover portion that extends from the axis over the open end of the container; and an actuation portion that engages with the mechanical actuator to pivot the lid from the closed position to the open position upon activation of the mechanical actuator.

The cover portion may be pivoted downwards when the lid pivots from the closed position to the open position, and the actuation portion is pivoted upwards when the lid pivots from the closed position to the open position.

In some embodiments, the actuation portion has a weight selected to bias the lid towards the closed position.

The mechanical actuator may, for example, comprise a lifting body that is configured to engage and lift the actuation portion when the mechanical actuator is activated.

The actuation portion of the lid is optionally configured to be mechanically disengaged from the lifting body when the lid is in the open position and the mechanical actuator is inactive.

The mechanical actuator may comprise a motor that is configured to move the lifting body upwards when activated. The mechanical actuator may further comprise a gear wheel;

wherein the lifting body comprises a pin that extends from a face of the gear wheel;

wherein the motor is configured to rotate the gear wheel when activated; and wherein the pin is configured to lift the actuation portion of the lid when the gear wheel is rotated upon activation of the motor.

The gear wheel may, for example, comprise a worm wheel, and the mechanical actuator further comprises a worm screw;

wherein the motor is configured to rotate the worm screw when activated; and wherein the worm screw is configured to engage with the worm wheel to effect rotation of the worm wheel upon activation of the motor.

Optionally, the solar panel is a first solar panel, the shade-operated movable barrier further comprising one or more additional solar panels; and wherein the predetermined extent amount is determined in relation to an amount of electricity generated by the one or more additional solar panels.

The one or more additional solar panels may be arranged relative to the first solar panel so that, when the object is placed at a predetermined location over the first solar panel so as to cast shade on the first solar panel, the one or more additional solar panels are at least partially unshaded;

wherein a relative electricity output of the first solar panel and the one or more additional solar panels reflects a presence or an absence of the object at the predetermined location; and wherein the controller is configured to activate the mechanical actuator based on the relative electricity output.

The blocking member may comprise a first flap, a second flap, a third flap, and a fourth flap;

wherein the one or more additional solar panels comprise a second solar panel, a third solar panel, and a fourth solar panel;

wherein the first flap comprises the first solar panel, the second flap comprises the second solar panel, the third flap comprises the third solar panel, and the fourth flap comprises the fourth solar panel;

wherein the mechanical actuator is configured to open the first flap when a first activation signal is received from the controller, to open the second flap when a second activation signal is received from the controller, to open the third flap when a third activation signal is received from the controller, and to open the fourth flap when a fourth activation signal is received from the controller;

wherein the controller is configured to send the first activation signal to the mechanical actuator when the electricity generated by the first solar panel is reduced in comparison with the electricity generated by one or more of the second, third, and fourth solar panels;

wherein the controller is configured to send the second activation signal to the mechanical actuator when the electricity generated by the second solar panel is reduced in comparison with the electricity generated by one or more of the first, third, and fourth solar panels;

wherein the controller is configured to send the third activation signal to the mechanical actuator when the electricity generated by the third solar panel is reduced in comparison with the electricity generated by one or more of the first, third, and fourth solar panels; and wherein the controller is configured to send the fourth activation signal to the mechanical actuator when the electricity generated by the fourth solar panel is reduced in comparison with the electricity generated by one or more of the first, second, and third solar panels.

Preferably, the mechanical actuator is configured to hold the first flap open for a predetermined time period when the first activation signal is received from the controller, and then to allow the first flap to close after the predetermined time period has ended;

wherein the mechanical actuator is configured to hold the second flap open for the predetermined time period when the second activation signal is received from the controller, and then to allow the second flap to close after the predetermined time period has ended;

wherein the mechanical actuator is configured to hold the third flap open for the predetermined time period when the third activation signal is received from the controller, and then to allow the third flap to close after the predetermined time period has ended; and wherein the mechanical actuator is configured to hold the fourth flap open for the predetermined time period when the fourth activation signal is received from the controller, and then to allow the fourth flap to close after the predetermined time period has ended.

The mechanical actuator may be configured to simultaneously open the first flap, the second flap, the third flap, and the fourth flap when a fifth activation signal is received from the controller; and wherein the controller is configured to send the fifth activation signal to the mechanical actuator when, after having sent the first, second, third, or fourth activation signal, the electricity generated by the first solar panel, the second solar panel, the third solar panel, or the fourth solar panel, respectively, remains reduced after the predetermined time period has ended.

In a further aspect, the present invention resides in a container comprising: a receptacle with an open upper end for receiving material; a lid that is movably supported relative to the receptacle, the lid being movable between a closed condition, in which the lid at least partially covers the open end of the receptacle, and an open condition, in which the lid is moved so as to provide access to the open end of the receptacle; a sidewall that is spaced from and movably supported relative to the receptacle, the sidewall being movable between a first position, in which the sidewall is spaced a first distance from the receptacle, and a second position, in which the sidewall is spaced a second distance from the receptacle, the first distance being greater than the second distance; and an actuation mechanism that is configured to effect movement of the lid from the closed condition to the open condition upon movement of the sidewall from the first position to the second position.

Preferably, the movement of the sidewall from the first position to the second position comprises tilting the sidewall towards the receptacle.

In some preferred embodiments, the container further comprises a lid support member that projects inwardly from the sidewall; wherein the receptacle comprises a camming surface; wherein the sidewall is spaced outwardly from the camming surface; wherein the lid comprises a lid panel that is pivotably mounted to the lid support member for pivoting about a horizontal axis, the lid panel comprising: a cover portion that extends from the axis over the open end of the receptacle; and an actuation portion that extends from the axis towards the sidewall; the lid panel being pivotable about the axis between a closed position, in which the cover portion at least partially covers the open end of the receptacle, and an open position, in which the actuation portion is pivoted upwards from the closed position and the cover portion is pivoted downwards from the closed position to provide access to the open end of the receptacle; the actuation portion comprising a cam surface that is positioned between the camming surface and the sidewall, the cam surface being configured to engage with the camming surface to pivot the actuation portion of the lid panel upwards, towards the open position, when the sidewall is moved from the first position to the second position.

Preferably, the actuation portion of the lid panel has a weight selected to bias the lid panel towards the closed position; and the sidewall is configured to move from the first position to the second position upon application of a horizontal force to the sidewall.

In some embodiments, the cam surface is configured to apply a biasing force, provided by the weight of the actuation portion of the lid panel, to the camming surface when the sidewall is at the second position, the biasing force biasing the sidewall towards the first position.

Optionally, the lid panel is pivotable from the closed position to the open position by manually depressing the cover portion of the lid panel, without moving the sidewall from the first position to the second position.

Preferably, the cam surface is configured to be mechanically disengaged from the camming surface when the lid panel is in the open position and the sidewall is at the first position.

In some embodiments, the container further comprises a lifting assembly that is operable to lift the actuation portion of the lid panel when activated, to pivot the lid panel from the closed position to the open position, without moving the sidewall from the first position to the second position; the lifting assembly comprising a lifting body that is configured to engage and lift the actuation portion when the lifting assembly is activated and the sidewall is at the first position.

Preferably, the actuation portion of the lid panel is configured to be mechanically disengaged from the lifting body when the lid panel is in the open position and the lifting assembly is inactive.

In some preferred embodiments, the lifting assembly further comprises a motor that is configured to move the lifting body upwards when activated.

Optionally, the actuation portion of the lid panel further comprises a battery for powering the motor, the battery having a weight selected to bias the lid panel towards the closed position.

In some embodiments, the lifting assembly further comprises a gear wheel that is rotatably mounted to the sidewall; wherein the lifting body comprises a pin that extends from an inwardly facing surface of the gear wheel towards the receptacle; wherein the motor is configured to rotate the gear wheel when activated; wherein the pin is configured to lift the actuation portion of the lid panel when the gear wheel is rotated upon activation of the motor; wherein the motor is mounted to the sidewall; wherein the gear wheel comprises a worm wheel, and the lifting assembly further comprises a worm screw; wherein the motor is configured to rotate the worm screw when activated; and wherein the worm screw is configured to engage with the worm wheel to effect rotation of the worm wheel upon activation of the motor.

Optionally, the cover portion of the lid panel comprises a solar panel that is configured to generate electricity from a light source; wherein the electricity generated by the solar panel is reduced when an object is placed over the cover portion so as to cast shade on the solar panel; wherein the lifting assembly further comprises a controller that is configured to control activation of the motor; and wherein the controller is configured to activate the motor when the electricity generated by the solar panel is reduced by a predetermined extent.

Preferably, the solar panel is configured to generate electricity for powering the motor.

In some embodiments, the receptacle comprises a bin, the bin having a bin wall with an outwardly facing surface; wherein the outwardly facing surface of the bin wall comprises the camming surface; wherein the container further comprises a shroud with a hollow interior, the bin being disposed within the hollow interior; wherein the shroud incorporates the sidewall; wherein the shroud is configured to sit on a support surface, without being rigidly secured to the support surface, so that the shroud is tiltable towards the outwardly facing surface of the bin wall; wherein the sidewall is at the first position when the shroud is sitting squarely on the support surface, and is at the second position when the shroud is tilted at a predetermined angle towards the outwardly facing surface of the bin wall; and wherein the shroud is removable from the bin.

Optionally, the camming surface is a first camming surface, the bin further comprising a second camming surface, a third camming surface, and a fourth camming surface; wherein the sidewall is a first sidewall and the lid support member is a first lid support member, the shroud further comprising: a second sidewall that is spaced outwardly from the second camming surface; a second lid support member that projects inwardly from the second sidewall; a third sidewall that is spaced outwardly from the third camming surface; a third lid support member that projects inwardly from the third sidewall; a fourth sidewall that is spaced outwardly from the fourth camming surface; and a fourth lid support member that projects inwardly from the fourth sidewall; wherein the lid panel is a first lid panel, the container further comprising: a second lid panel that is pivotably mounted to the second lid support member for pivoting about a second horizontal axis, the second lid panel comprising: a second cover portion that extends from the second axis over the open end of the receptacle; and a second actuation portion that extends from the second axis towards the second sidewall; the second lid panel being pivotable about the second axis between a closed position, in which the second cover portion at least partially covers the open end of the receptacle, and an open position, in which the second actuation portion is pivoted upwards from the closed position and the second cover portion is pivoted downwards from the closed position to provide access to the open end of the receptacle; the second actuation portion of the second lid panel having a weight selected to bias the second lid panel towards the closed position; the second actuation portion comprising a second cam surface that is positioned between the second camming surface and the second sidewall, the second cam surface being configured to engage with the second camming surface to pivot the second actuation portion of the second lid panel upwards, towards the open position, when the shroud is tilted at the predetermined angle towards the second camming surface; a third lid panel that is pivotably mounted to the third lid support member for pivoting about a third horizontal axis, the third lid panel comprising: a third cover portion that extends from the third axis over the open end of the receptacle; and a third actuation portion that extends from the third axis towards the third sidewall; the third lid panel being pivotable about the third axis between a closed position, in which the third cover portion at least partially covers the open end of the receptacle, and an open position, in which the third actuation portion is pivoted upwards from the closed position and the third cover portion is pivoted downwards from the closed position to provide access to the open end of the receptacle; the third actuation portion of the third lid panel having a weight selected to bias the third lid panel towards the closed position; the third actuation portion comprising a third cam surface that is positioned between the third camming surface and the third sidewall, the third cam surface being configured to engage with the third camming surface to pivot the third actuation portion of the third lid panel upwards, towards the open position, when the shroud is tilted at the predetermined angle towards the third camming surface; and a fourth lid panel that is pivotably mounted to the fourth lid support member for pivoting about a fourth horizontal axis, the fourth lid panel comprising: a fourth cover portion that extends from the fourth axis over the open end of the receptacle; and a fourth actuation portion that extends from the fourth axis towards the fourth sidewall; the fourth lid panel being pivotable about the fourth axis between a closed position, in which the fourth cover portion at least partially covers the open end of the receptacle, and an open position, in which the fourth actuation portion is pivoted upwards from the closed position and the fourth cover portion is pivoted downwards from the closed position to provide access to the open end of the receptacle; the fourth actuation portion of the fourth lid panel having a weight selected to bias the fourth lid panel towards the closed position; the fourth actuation portion comprising a fourth cam surface that is positioned between the fourth camming surface and the fourth sidewall, the fourth cam surface being configured to engage with the fourth camming surface to pivot the fourth actuation portion of the fourth lid panel upwards, towards the open position, when the shroud is tilted at the predetermined angle towards the fourth camming surface.

In preferred embodiments, the movement of the sidewall from the first position to the second position comprises tilting the sidewall towards the receptacle; wherein the lid panel is biased towards the closed position; wherein the sidewall is biased to return to the first position from the second position; wherein the cam surface is configured to be mechanically disengaged from the camming surface when the lid panel is in the open position and the sidewall is at the first position; the container further comprising a lifting assembly that is operable to lift the actuation portion of the lid panel when activated, to pivot the lid panel from the closed position to the open position, without moving the sidewall from the first position to the second position; the lifting assembly comprising a lifting body that is configured to engage and lift the actuation portion when the lifting assembly is activated and the sidewall is at the first position; wherein the actuation portion of the lid panel is configured to be mechanically disengaged from the lifting body when the lid panel is in the open position and the lifting assembly is inactive; and wherein the lifting assembly further comprises a motor that is configured to move the lifting body upwards when activated.

Preferably, the actuation portion of the lid panel has a weight selected to bias the lid panel towards the closed position; wherein the receptacle comprises a bin, the bin having a bin wall with an outwardly facing surface; wherein the outwardly facing surface of the bin wall comprises the camming surface; wherein the container further comprises a shroud with a hollow interior, the bin being disposed within the hollow interior; wherein the shroud incorporates the sidewall; wherein the shroud is configured to sit on a support surface, without being rigidly secured to the support surface, so that the shroud is tiltable towards the outwardly facing surface of the bin wall; wherein the sidewall is at the first position when the shroud is sitting squarely on the support surface, and is at the second position when the shroud is tilted at a predetermined angle towards the outwardly facing surface of the bin wall.

In preferred embodiments, the container is a waste container.

Optionally, the sidewall is a first sidewall, the container further comprising a second sidewall, a third sidewall, and a fourth sidewall; wherein the first sidewall, the second sidewall, the third sidewall, and the fourth sidewall together form a shroud that encircles the receptacle, with the third sidewall being positioned at an opposite side of the shroud from the first sidewall; wherein the first sidewall, the second sidewall, the third sidewall, and the fourth sidewall each have a bottom edge that is configured to sit squarely on a support surface adjacent to the receptacle when the first sidewall is at the first position; wherein the movement of the first sidewall from the first position to the second position comprises pivoting the shroud about a horizontal pivot axis defined by the bottom edge of the third sidewall; and wherein the bottom edge of the first sidewall is spaced from the support surface and the bottom edge of the third sidewall is in contact with the support surface when the first sidewall is at the second position.

In a further aspect, the present invention resides in a container comprising: a receptacle with an open upper end for receiving material; a lid that is movably supported relative to the receptacle, the lid being movable between a closed condition, in which the lid at least partially covers the open end of the receptacle, and an open condition, in which the lid is moved so as to provide access to the open end of the receptacle; characterized in that the container further comprises: a sidewall that is spaced from and movably supported relative to the receptacle, the sidewall being movable between a first position, in which the sidewall is spaced a first distance from the receptacle, and a second position, in which the sidewall is spaced a second distance from the receptacle, the first distance being greater than the second distance; and an actuation mechanism that is configured to effect movement of the lid from the closed condition to the open condition upon movement of the sidewall from the first position to the second position.

Preferably, the movement of the sidewall from the first position to the second position comprises tilting the sidewall towards the receptacle.

In preferred embodiments, the container further comprises a lid support member that projects inwardly from the sidewall; wherein the receptacle comprises a camming surface; wherein the sidewall is spaced outwardly from the camming surface; wherein the lid comprises a lid panel that is pivotably mounted to the lid support member for pivoting about a horizontal axis, the lid panel comprising: a cover portion that extends from the axis over the open end of the receptacle; and an actuation portion that extends from the axis towards the sidewall; the lid panel being pivotable about the axis between a closed position, in which the cover portion at least partially covers the open end of the receptacle, and an open position, in which the actuation portion is pivoted upwards from the closed position and the cover portion is pivoted downwards from the closed position to provide access to the open end of the receptacle; the actuation portion comprising a cam surface that is positioned between the camming surface and the sidewall, the cam surface being configured to engage with the camming surface to pivot the actuation portion of the lid panel upwards, towards the open position, when the sidewall is moved from the first position to the second position.

Preferably, the lid panel is biased towards the closed position; wherein the sidewall is configured to move from the first position to the second position upon application of a horizontal force to the sidewall; and wherein the sidewall is biased to return to the first position from the second position.

Optionally, the lid panel is pivotable from the closed position to the open position by manually depressing the cover portion of the lid panel, without moving the sidewall from the first position to the second position.

In preferred embodiments, the cam surface is configured to be mechanically disengaged from the camming surface when the lid panel is in the open position and the sidewall is at the first position.

In some embodiments, the container further comprises a lifting assembly that is operable to lift the actuation portion of the lid panel when activated, to pivot the lid panel from the closed position to the open position, without moving the sidewall from the first position to the second position; the lifting assembly comprising a lifting body that is configured to engage and lift the actuation portion when the lifting assembly is activated and the sidewall is at the first position.

Preferably, the actuation portion of the lid panel is configured to be mechanically disengaged from the lifting body when the lid panel is in the open position and the lifting assembly is inactive.

Optionally, the lifting assembly further comprises a motor that is configured to move the lifting body upwards when activated.

In some embodiments, the lifting assembly further comprises a gear wheel that is rotatably mounted to the sidewall; wherein the lifting body comprises a pin that extends from an inwardly facing surface of the gear wheel towards the receptacle; wherein the motor is configured to rotate the gear wheel when activated; wherein the pin is configured to lift the actuation portion of the lid panel when the gear wheel is rotated upon activation of the motor; wherein the motor is mounted to the sidewall; wherein the gear wheel comprises a worm wheel, and the lifting assembly further comprises a worm screw; wherein the motor is configured to rotate the worm screw when activated; and wherein the worm screw is configured to engage with the worm wheel to effect rotation of the worm wheel upon activation of the motor.

The cover portion of the lid panel optionally comprises a solar panel that is configured to generate electricity from a light source; wherein the electricity generated by the solar panel is reduced when an object is placed over the cover portion so as to cast shade on the solar panel; wherein the lifting assembly further comprises a controller that is configured to control activation of the motor; wherein the controller is configured to activate the motor when the electricity generated by the solar panel is reduced by a predetermined extent; and wherein the solar panel is configured to generate electricity for powering the motor.

In preferred embodiments, the receptacle comprises a bin, the bin having a bin wall with an outwardly facing surface; wherein the outwardly facing surface of the bin wall comprises the camming surface; wherein the container further comprises a shroud with a hollow interior, the bin being disposed within the hollow interior; wherein the shroud incorporates the sidewall; wherein the shroud is configured to sit on a support surface, without being rigidly secured to the support surface, so that the shroud is tiltable towards the outwardly facing surface of the bin wall; wherein the sidewall is at the first position when the shroud is sitting squarely on the support surface, and is at the second position when the shroud is tilted at a predetermined angle towards the outwardly facing surface of the bin wall; and wherein the shroud is removable from the bin.

In some embodiments, the camming surface is a first camming surface, the bin further comprising a second camming surface, a third camming surface, and a fourth camming surface; wherein the sidewall is a first sidewall and the lid support member is a first lid support member, the shroud further comprising: a second sidewall that is spaced outwardly from the second camming surface; a second lid support member that projects inwardly from the second sidewall; a third sidewall that is spaced outwardly from the third camming surface; a third lid support member that projects inwardly from the third sidewall; a fourth sidewall that is spaced outwardly from the fourth camming surface; and a fourth lid support member that projects inwardly from the fourth sidewall; wherein the lid panel is a first lid panel, the container further comprising: a second lid panel that is pivotably mounted to the second lid support member for pivoting about a second horizontal axis, the second lid panel comprising: a second cover portion that extends from the second axis over the open end of the receptacle; and a second actuation portion that extends from the second axis towards the second sidewall; the second lid panel being pivotable about the second axis between a closed position, in which the second cover portion at least partially covers the open end of the receptacle, and an open position, in which the second actuation portion is pivoted upwards from the closed position and the second cover portion is pivoted downwards from the closed position to provide access to the open end of the receptacle; the second actuation portion of the second lid panel having a weight selected to bias the second lid panel towards the closed position; the second actuation portion comprising a second cam surface that is positioned between the second camming surface and the second sidewall, the second cam surface being configured to engage with the second camming surface to pivot the second actuation portion of the second lid panel upwards, towards the open position, when the shroud is tilted at the predetermined angle towards the second camming surface; a third lid panel that is pivotably mounted to the third lid support member for pivoting about a third horizontal axis, the third lid panel comprising: a third cover portion that extends from the third axis over the open end of the receptacle; and a third actuation portion that extends from the third axis towards the third sidewall; the third lid panel being pivotable about the third axis between a closed position, in which the third cover portion at least partially covers the open end of the receptacle, and an open position, in which the third actuation portion is pivoted upwards from the closed position and the third cover portion is pivoted downwards from the closed position to provide access to the open end of the receptacle; the third actuation portion of the third lid panel having a weight selected to bias the third lid panel towards the closed position; the third actuation portion comprising a third cam surface that is positioned between the third camming surface and the third sidewall, the third cam surface being configured to engage with the third camming surface to pivot the third actuation portion of the third lid panel upwards, towards the open position, when the shroud is tilted at the predetermined angle towards the third camming surface; and a fourth lid panel that is pivotably mounted to the fourth lid support member for pivoting about a fourth horizontal axis, the fourth lid panel comprising: a fourth cover portion that extends from the fourth axis over the open end of the receptacle; and a fourth actuation portion that extends from the fourth axis towards the fourth sidewall; the fourth lid panel being pivotable about the fourth axis between a closed position, in which the fourth cover portion at least partially covers the open end of the receptacle, and an open position, in which the fourth actuation portion is pivoted upwards from the closed position and the fourth cover portion is pivoted downwards from the closed position to provide access to the open end of the receptacle; the fourth actuation portion of the fourth lid panel having a weight selected to bias the fourth lid panel towards the closed position; the fourth actuation portion comprising a fourth cam surface that is positioned between the fourth camming surface and the fourth sidewall, the fourth cam surface being configured to engage with the fourth camming surface to pivot the fourth actuation portion of the fourth lid panel upwards, towards the open position, when the shroud is tilted at the predetermined angle towards the fourth camming surface.

Optionally, the sidewall is a first sidewall, the container further comprising a second sidewall, a third sidewall, and a fourth sidewall; wherein the first sidewall, the second sidewall, the third sidewall, and the fourth sidewall together form a shroud that encircles the receptacle, with the third sidewall being positioned at an opposite side of the shroud from the first sidewall; wherein the first sidewall, the second sidewall, the third sidewall, and the fourth sidewall each have a bottom edge that is configured to sit squarely on a support surface adjacent to the receptacle when the first sidewall is at the first position; wherein the movement of the first sidewall from the first position to the second position comprises pivoting the shroud about a horizontal pivot axis defined by the bottom edge of the third sidewall; and wherein the bottom edge of the first sidewall is spaced from the support surface and the bottom edge of the third sidewall is in contact with the support surface when the first sidewall is at the second position.

Preferably, the container is a waste container.

BRIEF DESCRIPTION OF THE DRAWINGS

Further aspects and advantages of the invention will appear from the following description taken together with the accompanying drawings, in which.

DETAILED DESCRIPTION OF THE DRAWINGS

Figure 1:
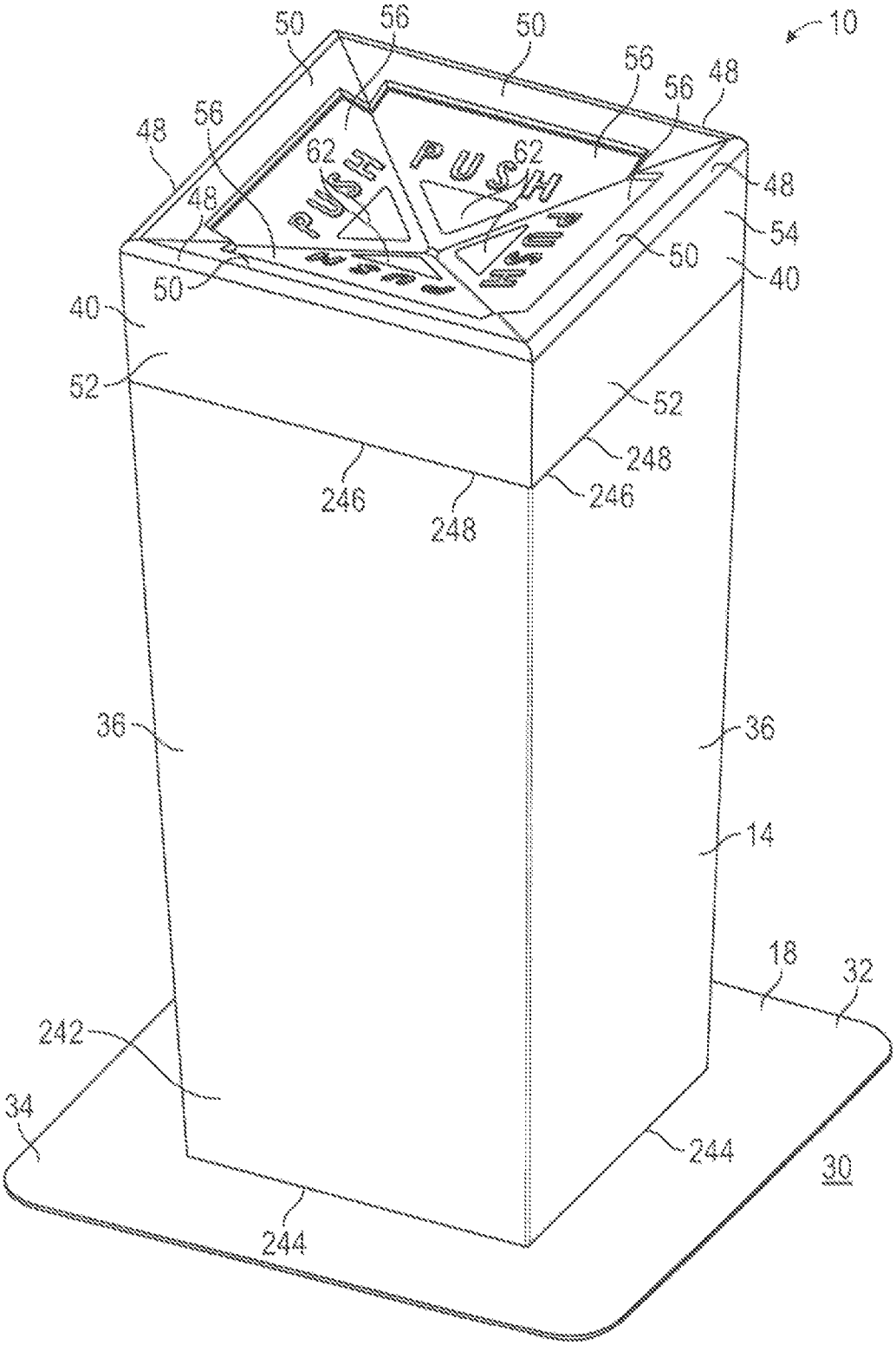
FIG. 1 is a perspective view of a waste container in accordance with a first embodiment of the present invention, with the waste container shown in an assembled and closed state.
Figure 2:
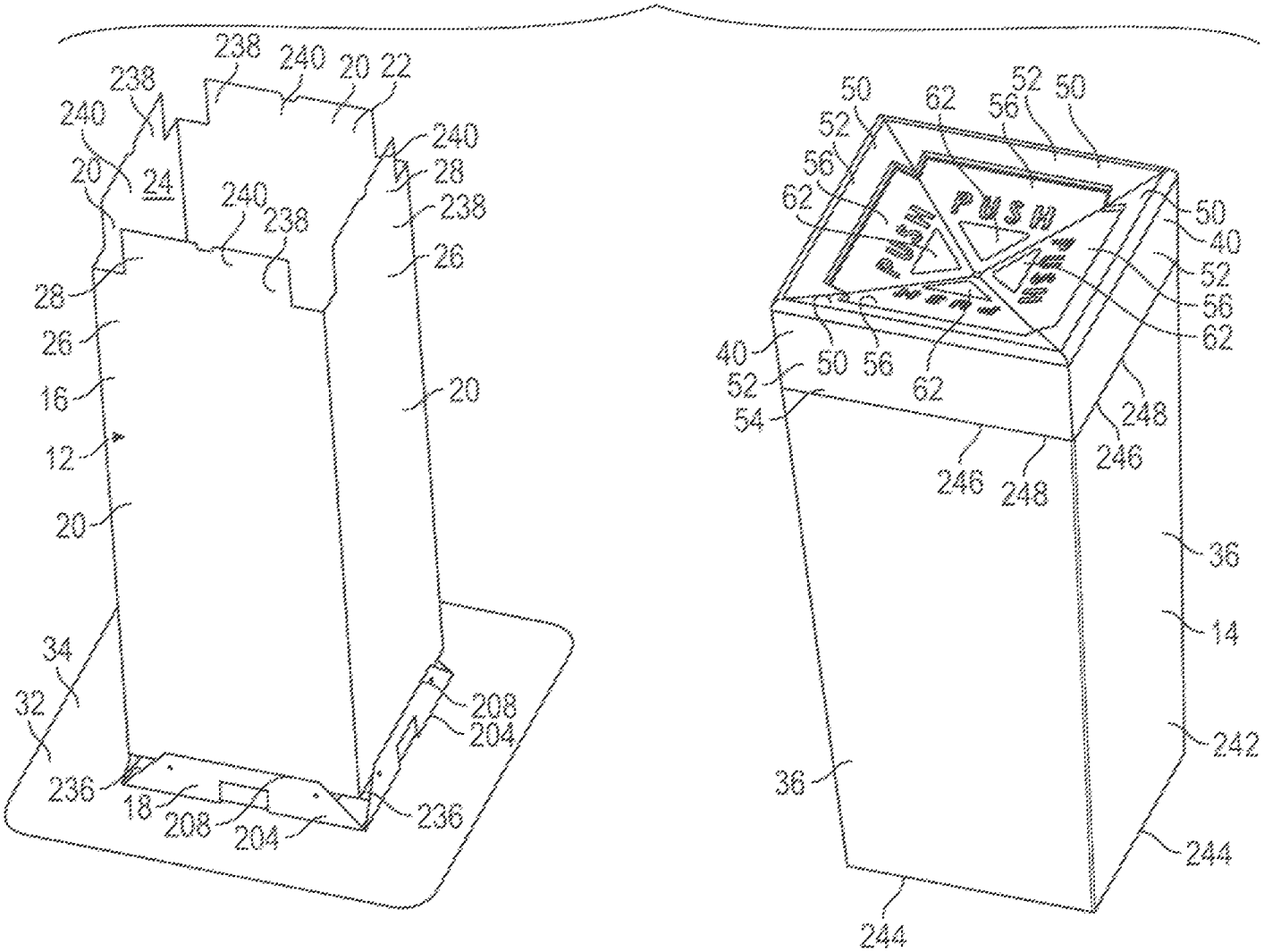
FIG. 2 is a partially exploded perspective view of the waste container shown in FIG. 1, with the waste container shown in a disassembled state, wherein an outer shroud of the container has been removed from an inner receptacle.

FIGS. 1 and 2 show a waste container 10 in accordance with a first embodiment of the invention. The waste container 10 includes a mounting bracket 18, an inner receptacle 12, and an outer shroud 14.

Figure 2A:
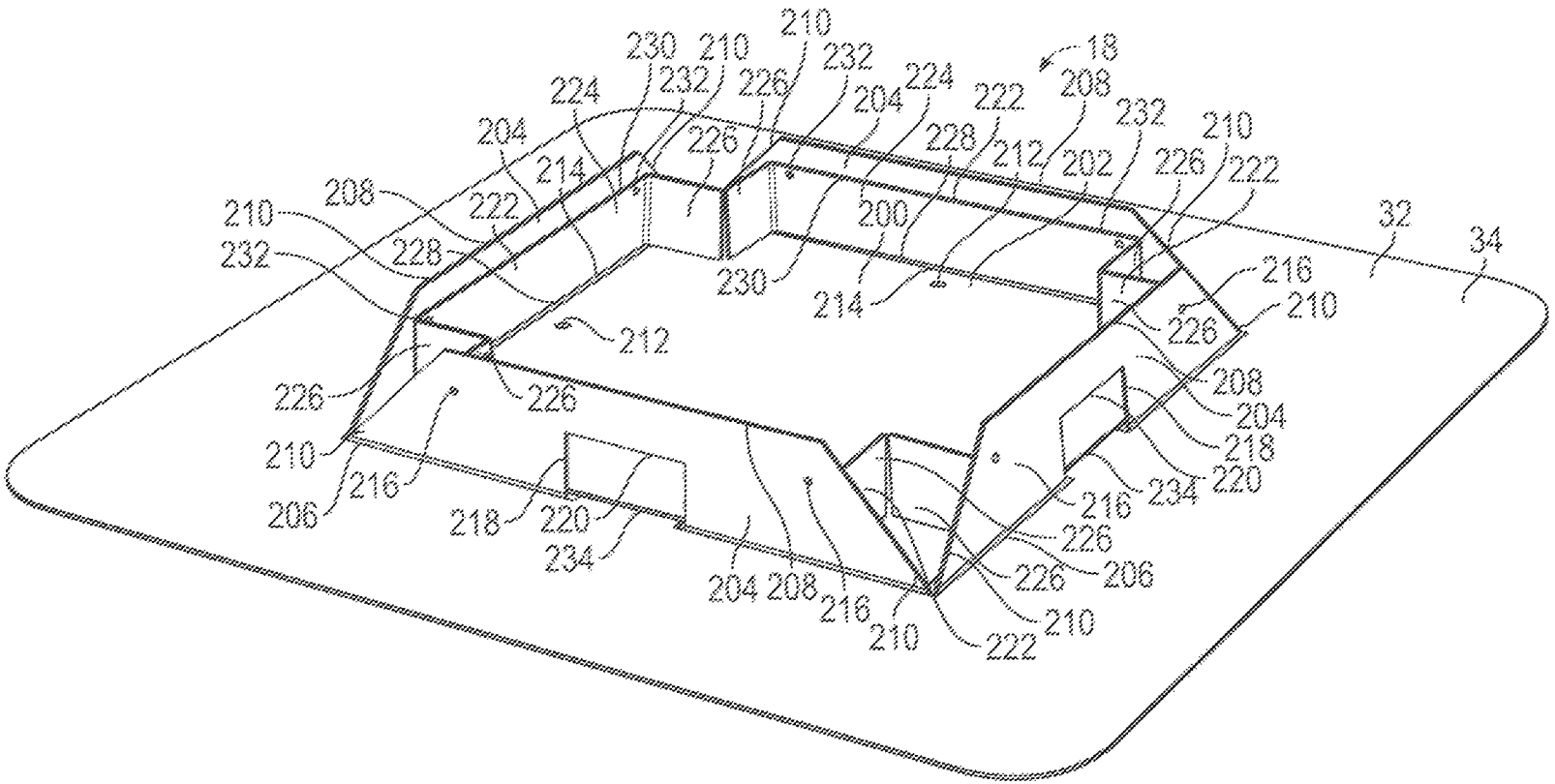
FIG. 2*a* is a perspective view of a mounting bracket of the waste container shown in FIG. 1.

The mounting bracket 18 is best seen in FIG. 2*a*. The mounting bracket 18 has a central mounting portion 200 and a peripheral foot portion 32. The mounting portion 200 has a square bottom panel 202 with four sides 214 and four bolt holes 212, although only two of the bolt holes 212 are visible in FIG. 2*a*. Each of the bolt holes 212 is positioned adjacent to a respective one of the sides 214. Four mounting guides 204 project upwardly from each respective one of the square bottom panel's 202 sides 214. Each mounting guide 204 is a thin metal flap having a generally trapezoidal shape. The mounting guides 204 each have a long bottom edge 206 that runs along one respective side 214 of the square bottom panel 202. The mounting guides 204 each extend upwards from the long bottom edge 206 to a short top edge 208. The long bottom edges 206 and the short top edges 208 are connected by angled side edges 210. Each mounting guide 204 has two bolt holes 216 and a rectangular opening 218. The bolt holes 216 are positioned near the top corners of the mounting guides 204, where the angled side edges 210 meet the top edges 208. Each rectangular opening 218 extends upwards from the center of the long bottom edge 206 of a respective one of the mounting guides 204, up to an upper boundary edge 220 that is spaced downwards from the top edge 208 of the mounting guide 204. The mounting guides 204 are each angled slightly inwardly towards the center of the bottom panel 204.

The mounting portion 200 also includes four support members 222. Each support member 222 is a thin metal strip with a long straight back 224 and two terminal end portions 226 that extend from each end of the long straight back 224 at about 90 degrees. Each support member 222 has a bottom side 228 that rests on the bottom panel 202, with the long straight back 224 running along a respective one of the bottom panel's 202 sides 214 and with the terminal end portions 226 extending inwardly towards the center of the bottom panel 202. Each support member 222 also has a top side 230 that is spaced upwardly and away from the bottom panel 202, and two bolt holes 232. The bolt holes 232 pass through the long straight back 224 near the top side 230 at respective upper corners near where the terminal end portions 226 extend from the straight back 224. Each support member 222 is spaced inwardly and adjacent to a respective one of the mounting guides 204, so that the bolt holes 232 in the support member 222 are aligned with the bolt holes 216 in the respective mounting guide 204. Although not shown, bolts or other fasteners extend through the bolt holes 232 and 216 to hold the support members 222 and the mounting guides 204 together.

The peripheral foot portion 32 of the mounting bracket 18 is a flat metal sheet that surrounds the mounting portion 200. The foot portion 32 has an upwardly facing support surface 34, and four attachment tabs 234 that each extend through a respective one of the rectangular openings 218 and under the bottom panel 202, although only two attachment tabs 234 are visible in FIG. 2*a*. Although not shown, the attachment tabs 234 have bolt holes that align with the bolt holes 212 in the bottom panel 202, and through which bolts or other fasteners extend to hold the bottom panel 202 and the foot portion 32 together. Preferably, the bolts or fasteners that extend through the bolt holes 212 also attach to the underlying floor surface 30 to secure the mounting bracket 18 to the floor 30. Although not necessary, in the embodiment shown the mounting guides 204 and the foot portion 32 are formed from a single piece of sheet metal, with the mounting guides 204 being bent upwardly from the foot portion 32 and the attachment tabs 234 being formed from cut-outs of the rectangular openings 218. The inner receptacle 14 is shown in FIG. 2 as a generally rectangular bin 16. The bin 16 has four identical outer walls 20 that each extend from a lower end 236 to an upper end 238. The upper end 238 of each outer wall 20 has an upwardly extending central tab 240. The four outer walls 20 define an inner chamber 22 with an open upper end 24. Each wall 20 has an outwardly facing surface 26 which serves as a camming surface 28 during use of the container 10, as is described in more detail below. The lower ends 236 of the outer walls 20 rest on the support members 222 of the mounting bracket 18, with the bin 16 positioned inwardly from the mounting guides 204. The top edges 208 of the mounting guides 204 are each positioned adjacent to a respective one of the outer walls 20, above its respective lower end 236. Although not shown, the lower ends 236 of the outer walls 20 are preferably rigidly secured to the mounting bracket 18 using bolts or other fasteners. Optionally, the bin 16 may be formed from a single piece of sheet metal that is bent to form the four outer walls 20, and cut to form the central tabs 240.

Figure 3:
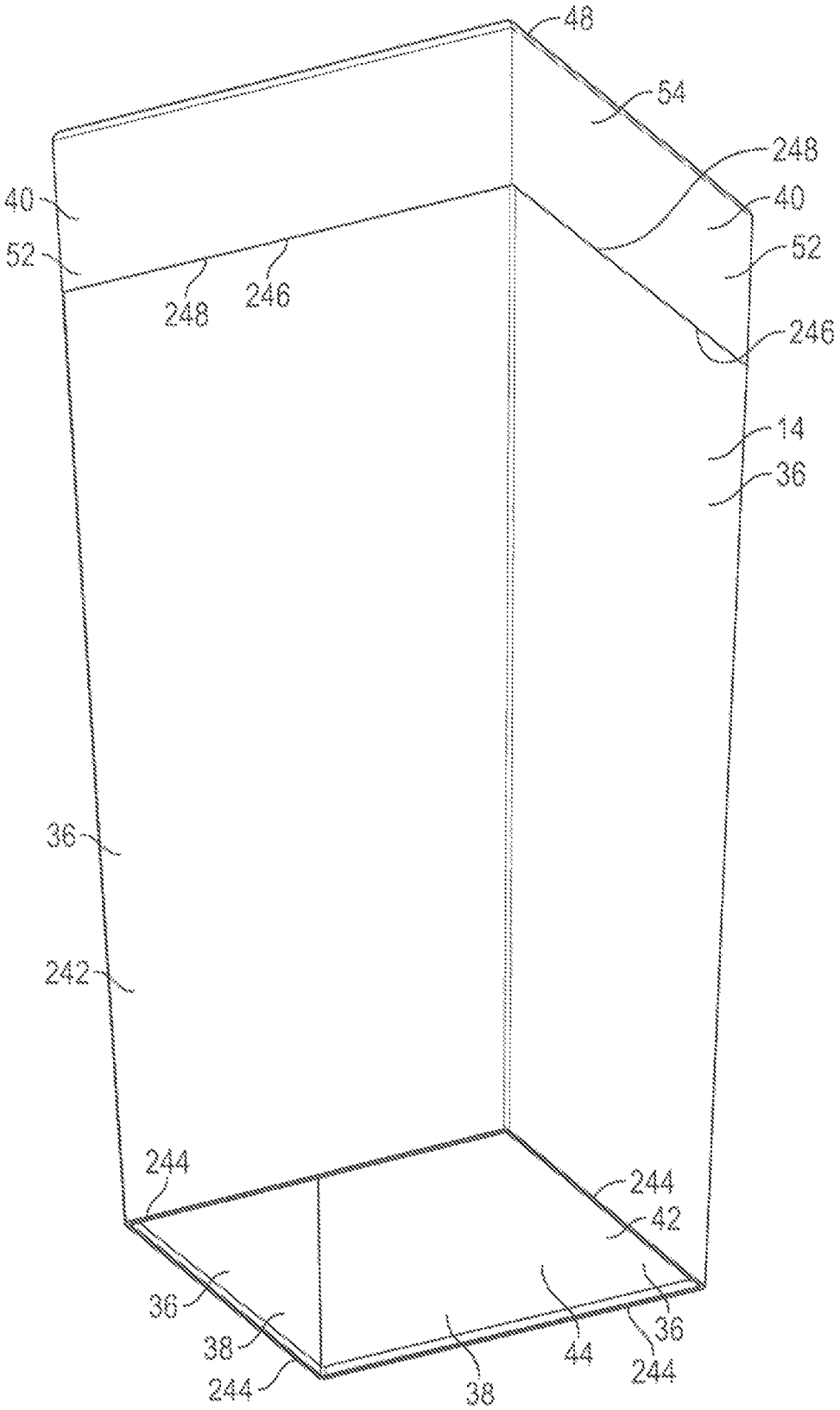
FIG. 3 is a perspective view of the outer shroud shown in FIG. 2, showing the open bottom end of the shroud.

The shroud 14 has a shroud head 54 and a shroud body 242. The shroud body 242 is formed from four identical sidewalls 36 that define a hollow interior cavity 44. The sidewalls 36 each extend from a bottom pivot edge 244 up to an upper support edge 246. As shown in FIG. 3, the shroud body 242 has an open bottom end 42.

The shroud head 54 has four upper sidewalls 40 that attach to and are supported by the upper support edges 246 of the sidewalls 36. Each upper sidewall 40 extends from a lower attachment edge 248 up to an upper corner edge 48. Each lower attachment edge 248 is configured to attach to a respective one of the upper support edges 246 of the sidewalls 36. The upper corner edges 48 are each integrally connected to a downwardly and inwardly sloping lid support body 50. An upper sidewall 40 and its attached lid support body 50 is sometimes referred to herein as an edge cap 52.

Figure 5:
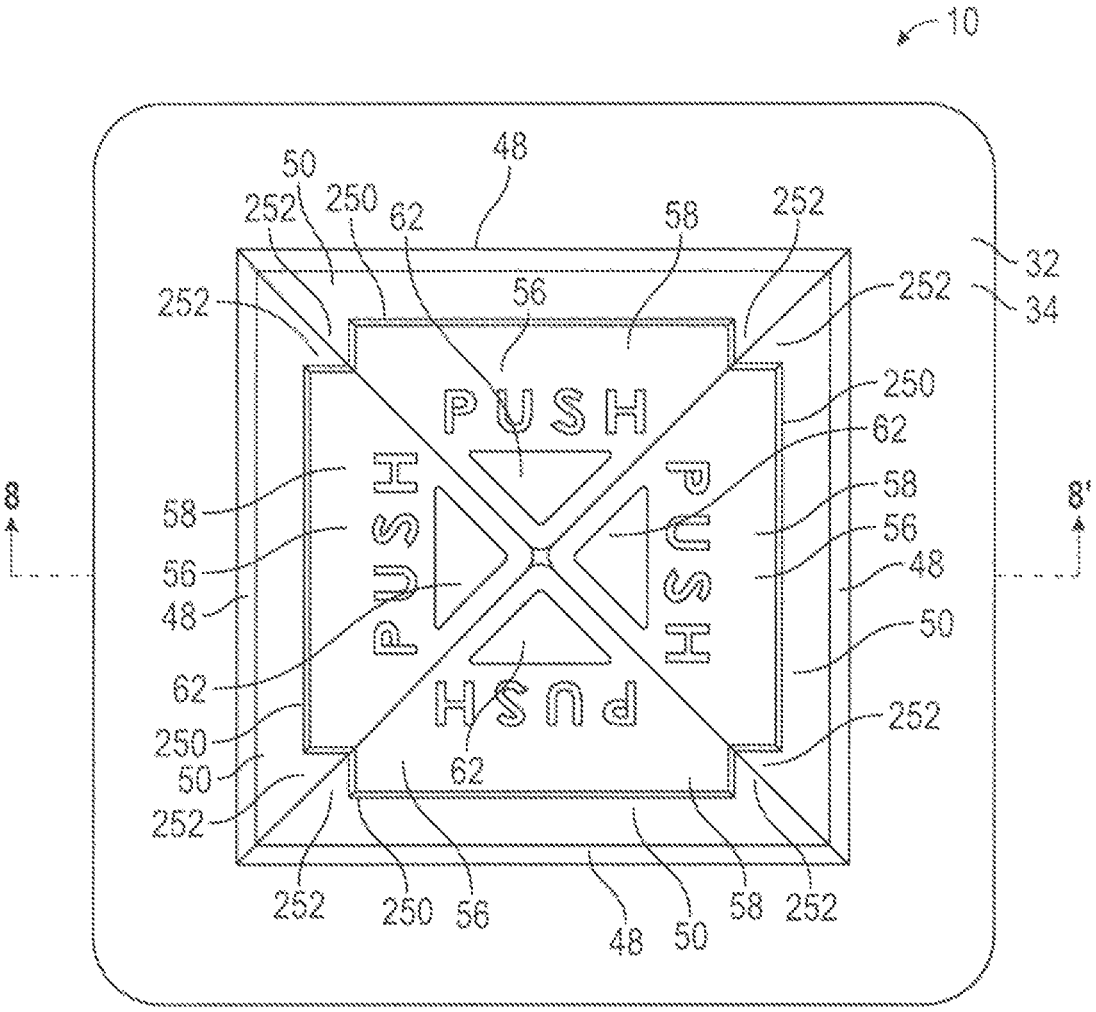
FIG. 5 is a top view of the closed waste container shown in FIG. 1, with the lid panels shown in a closed position.
Figure 10:
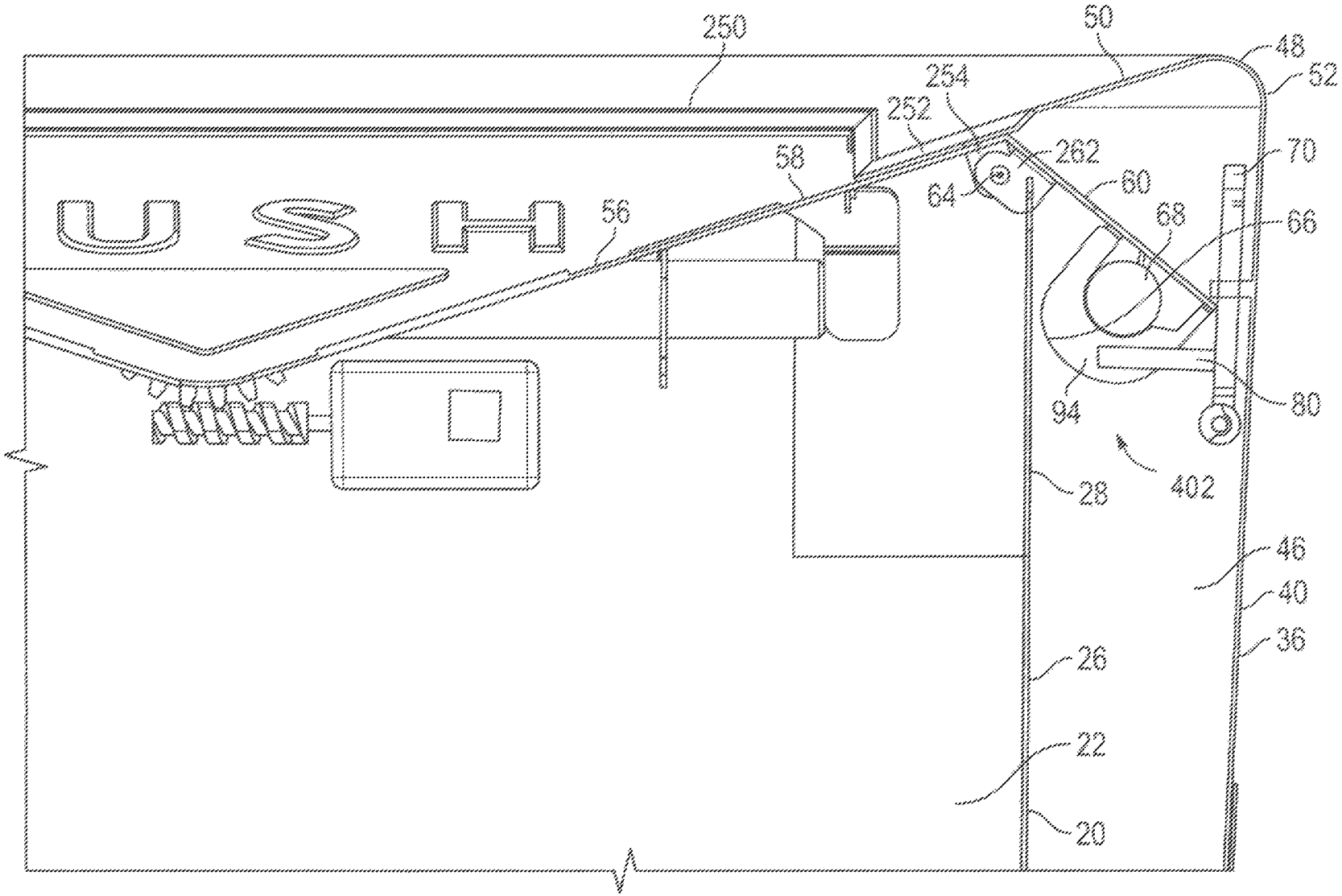
FIG. 10 is an enlarged view of the upper right portion of the cross-sectional view shown in FIG. 8, showing a cam surface of the lid panel positioned in a space between a sidewall of the shroud and a camming surface of the inner receptacle, with the sidewall positioned at a first location relative to the camming surface and the lid panel in the closed position.

As best seen in FIG. 5, each lid support body 50 extends inwardly from a respective one of the upper corner edges 48 to an inner edge 250 that runs parallel to the respective upper corner edge 48. The lid support body 50 extends further inwardly at each end of the inner edge 250 to form hinge support extensions 252, which extend perpendicularly to the inner edge 250. Each hinge support extension 252 has a downwardly extending journal tab 254, as best seen in FIG. 10. The lid support bodies 50 thus each have a pair of journal tabs 254 that extend downwardly from the hinge support extensions 252 on either end of the inner edge 250. Each pair of journal tabs 254 hingedly supports a lid 400 in the form of a lid panel 56.

Figure 7:
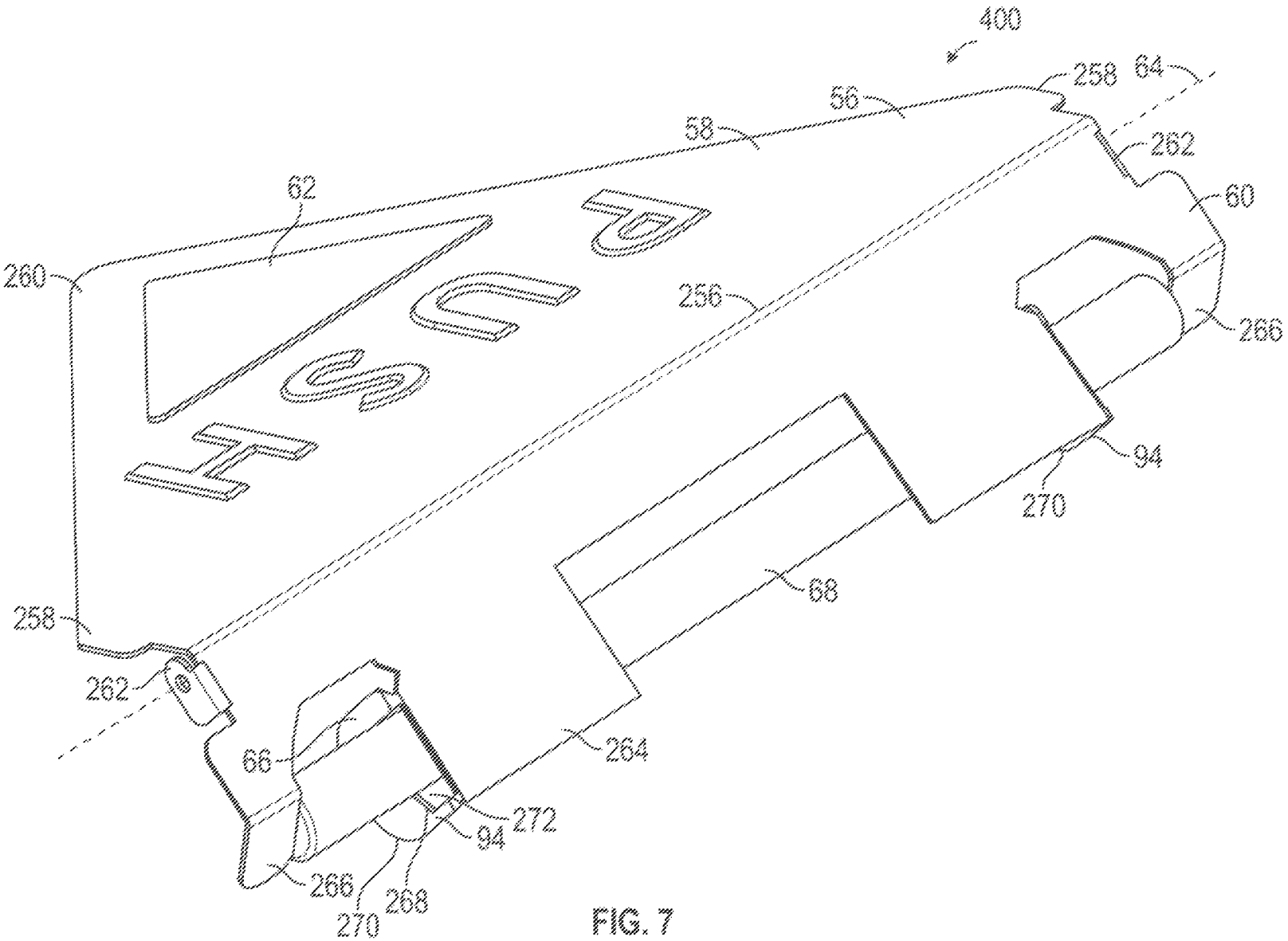
FIG. 7 is an isolated perspective view of the lid panel shown in FIG. 6 shown from above.
Figure 7A:
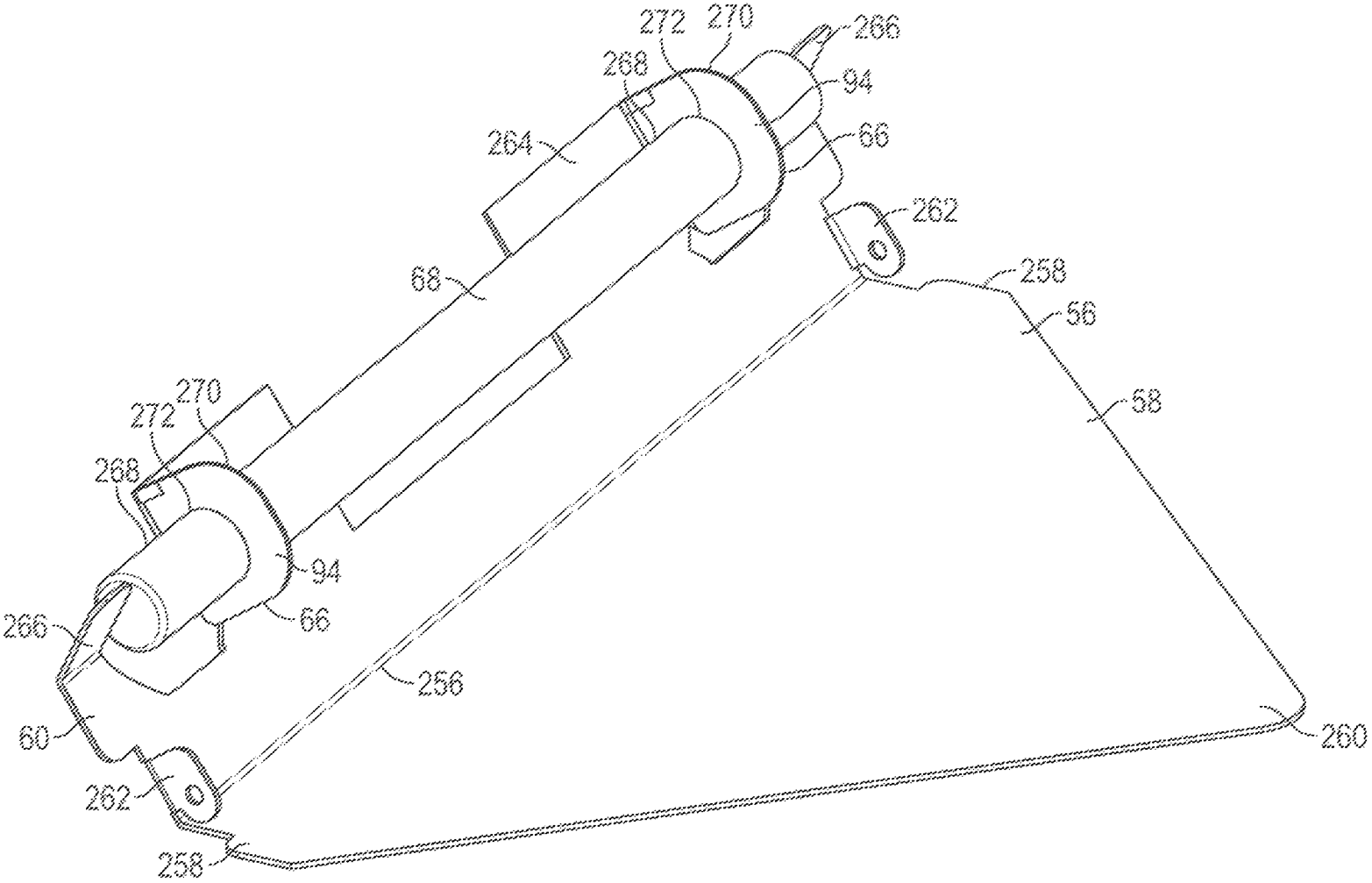
FIG. 7*a* is a perspective view of the lid panel of FIG. 7 shown from below.

As best shown in FIG. 7, each lid panel 56 has a thin panel body that is bent at an obtuse angle. The bend 256 divides the panel 56 into a cover portion 58 and an actuation portion 60. The cover portion 58 is a generally triangular flap which incorporates a solar panel 62. The width of the cover portion 58 increases near the bend 256 to provide a stop tab 258 at either side of the cover portion 58, and then tapers to a triangular end point 260.

Figure 11:
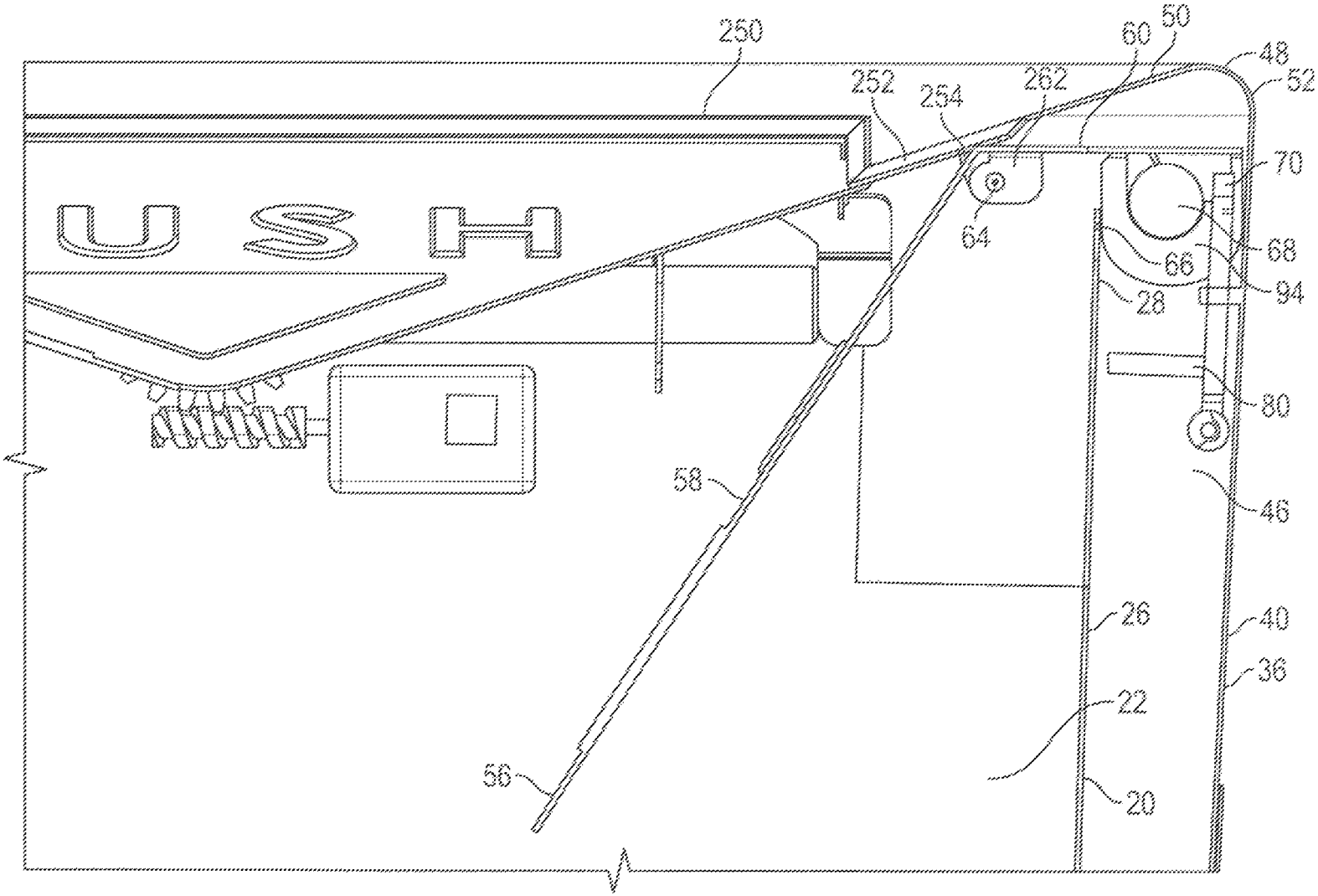
FIG. 11 is an enlarged view of the upper right portion of the cross-section shown in FIG. 9, showing the sidewall positioned at a second location closer to the camming surface, with the cam surface of the lid panel engaging with the camming surface and the lid panel in the open position.

The actuation portion 60 has two lid journal tabs 262 that extend downwardly from either side of the actuation portion 60 near the bend 256. As best seen in FIGS. 10 and 11, the lid journal tabs 262 are configured to align with the corresponding journal tabs 254 extending downwardly from the corresponding lid support body 50. Although not shown, a journal pin is inserted through each aligned pair of journal tabs 254 and lid journal tabs 262 to hingedly connect the lid panel 56 to the corresponding lid support body 50. This hinge mechanism permits the lid panel 56 to pivot about a horizontal axis 64. As can be seen in FIGS. 10 and 11, in cross-section the lid panel 56 looks like a generally L-shaped lever that pivots about the axis 64.

The actuation portion 60 also has a counterweight support structure 264 that is spaced away from the bend 256. The counterweight support structure 264 includes two downwardly extending U-shaped support members 94 and two downwardly extending stop members 266. The U-shaped support members 94 each have an internal surface 268 and an external surface 270. The internal surface 268 defines a counterweight seat 272 which is configured to receive and support a cylindrical counterweight 68, with the cylindrical counterweight 68 extending between and through the counterweight seats 272 of both U-shaped support members 94. The external surface 272 acts as a cam surface 66 during operation of the container 10, as is described in more detail below. The stop members 266 are positioned at either end of the counterweight 68 to hold the counterweight 68 in place and prevent it from sliding out of the counterweight seats 272.

Figure 17:
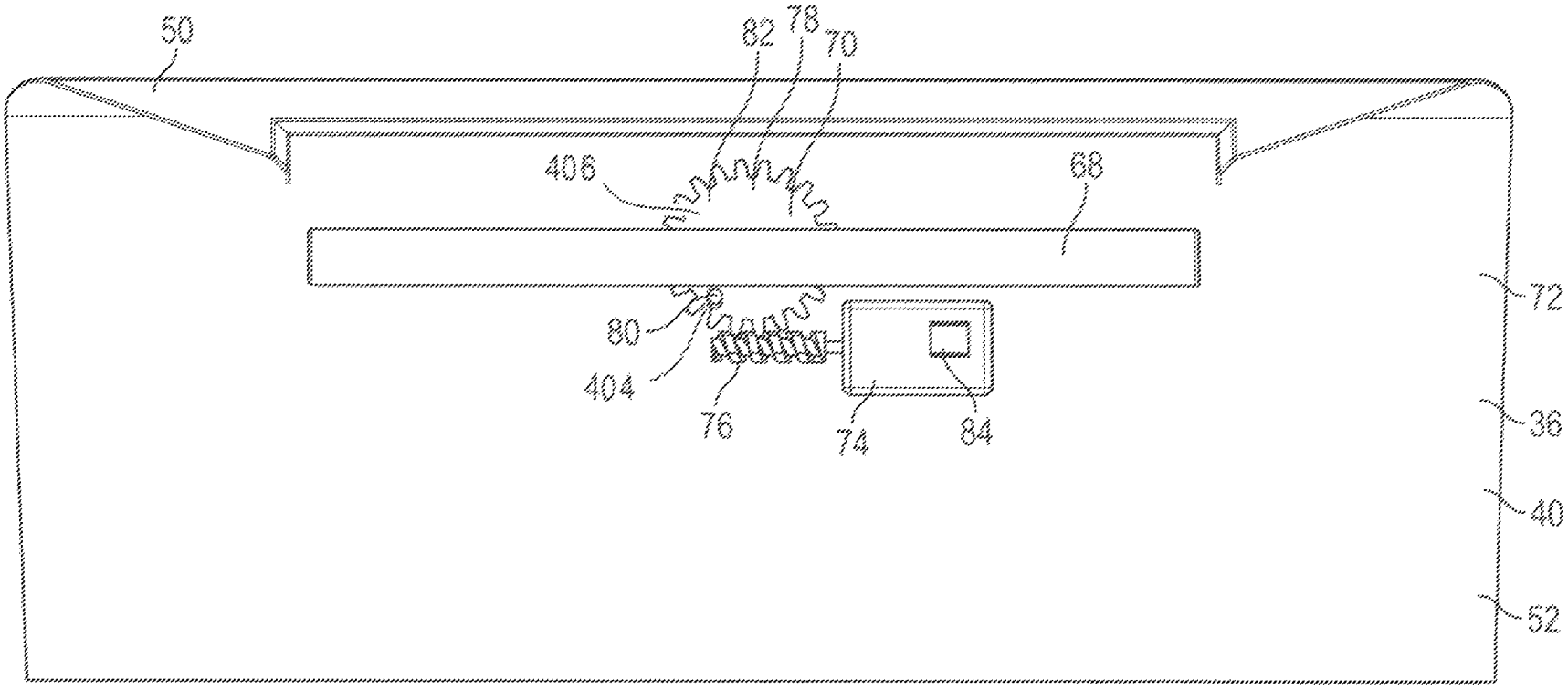
FIG. 17 shows an isolated view of an upper portion of the sidewall shown in FIG. 10, showing an inactive lifting assembly mounted to the sidewall, with the lid panel omitted except for a counterweight portion thereof.

As is best shown in FIG. 17, each upper sidewall 40 has a lifting assembly 70 mounted on its inside surface 72. The lifting assembly 70 includes an electric motor 74, a worm screw 76 that is operatively connected to the motor 74, and a gear wheel 406 in the form of a worm wheel 78 that is rotatably mounted above the worm screw 74. The worm wheel 78 has a lifting body 404 in the form of a pin 80 that extends from an inwardly facing surface 82 of the wheel 78. The lifting assembly 70 also includes a controller 84 that controls activation of the motor 74.

The relative positions, interactions, and functions of the components introduced above will now be described with reference to FIGS. 1 to 18.

The mounting bracket 18 is configured to sit on a floor surface 30, with the peripheral foot portion 32 providing stable contact with the floor surface 30. Preferably, the mounting bracket 18 is rigidly secured to the floor surface 30, such as by inserting bolts through the bolt holes 212 and into the floor 30, as described above.

Figure 2B:
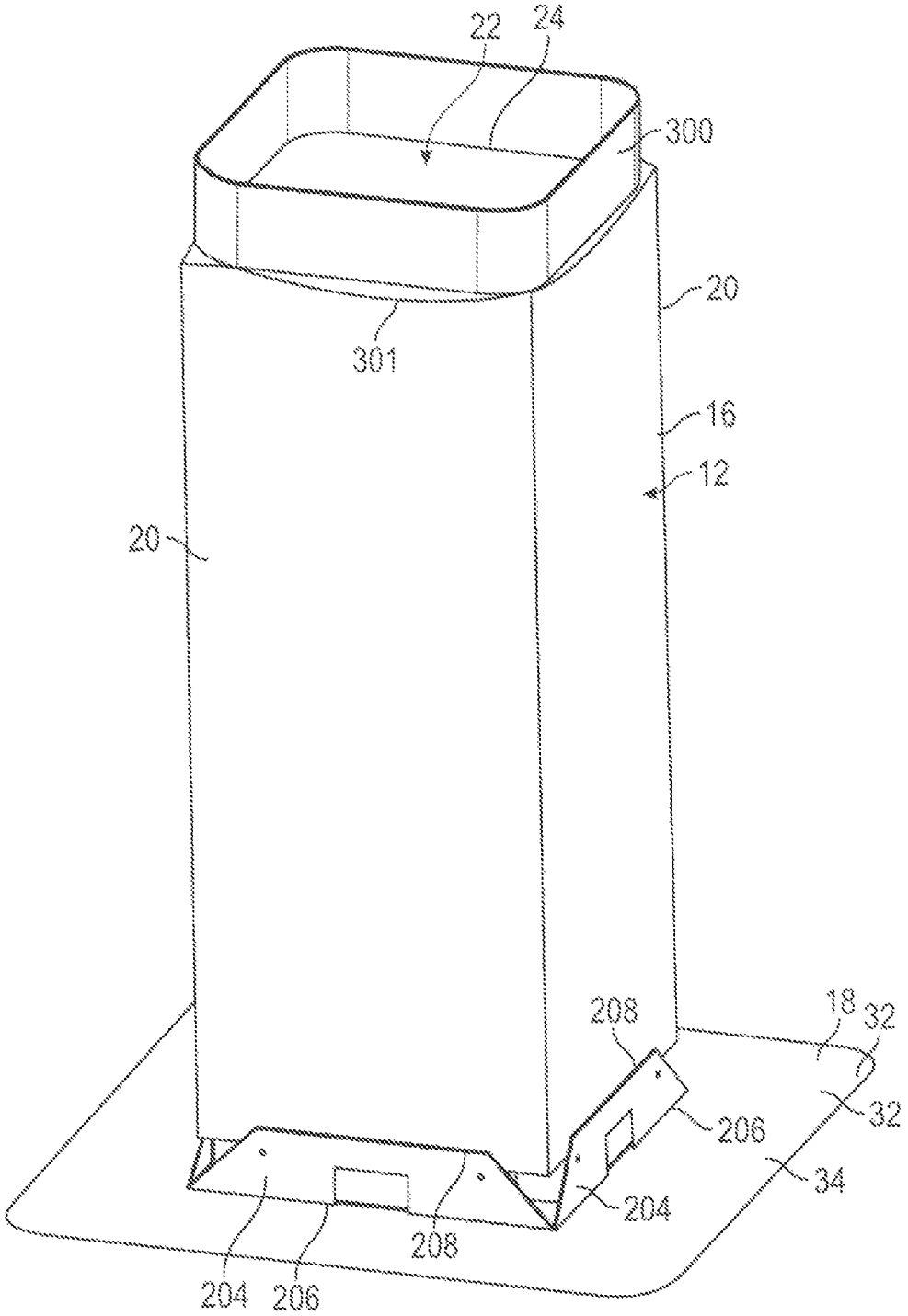
FIG. 2*b* is a perspective view of the inner receptacle shown in FIG. 2, with a garbage bag shown lining an inner chamber of the receptacle.

The bin 16 sits on the support members 222 of the mounting bracket 18, and is preferably rigidly connected thereto using bolts or the like. The inner chamber 22 of the bin 16 is for receiving waste materials such as scrap paper, discarded food, floor sweepings, and the like via the open upper end 24. The inner chamber 22 may optionally be lined with a garbage bag 300 for easy and sanitary emptying of its contents, as shown in FIG. 2*b*. As shown in FIG. 2*b*, the top edge 301 of the garbage bag 300 is folded down over the central tabs 240 seen on FIG. 2, to support the garbage bag 300. Preferably, the top edge 301 of the garbage bag 300 is stretched circumferentially about the central tabs 240 and does extend downwardly below the central tabs 240. As is described in more detail below, the camming surfaces 28 engage with the cam surfaces 66 during operation of the container 10. Having the camming surfaces 28 on the central tabs 240 covered by the thin plastic sheeting of the garbage bag 300 does not interfere with the operation of the container 10, albeit the engagement between the camming surfaces 28 and the cam surfaces 66 is with the garbage bags sandwiched therebetween. Rather than provide a garbage bag 300, a separate removable rigid leak-proof closed bottom and open topped liner box (not shown) preferably of plastic material may be placed inside the inner chamber 22 of the bin 16 for manual insertion and removal vertically.

The mounting bracket 18 and the bin 16 together form a rigid and relatively permanent structure which is intended to be installed and remain in one place for an extended period of time. The shroud 14, on the other hand, is both movable and removable relative to the bin 16 and the mounting bracket 18.

Figure 8:
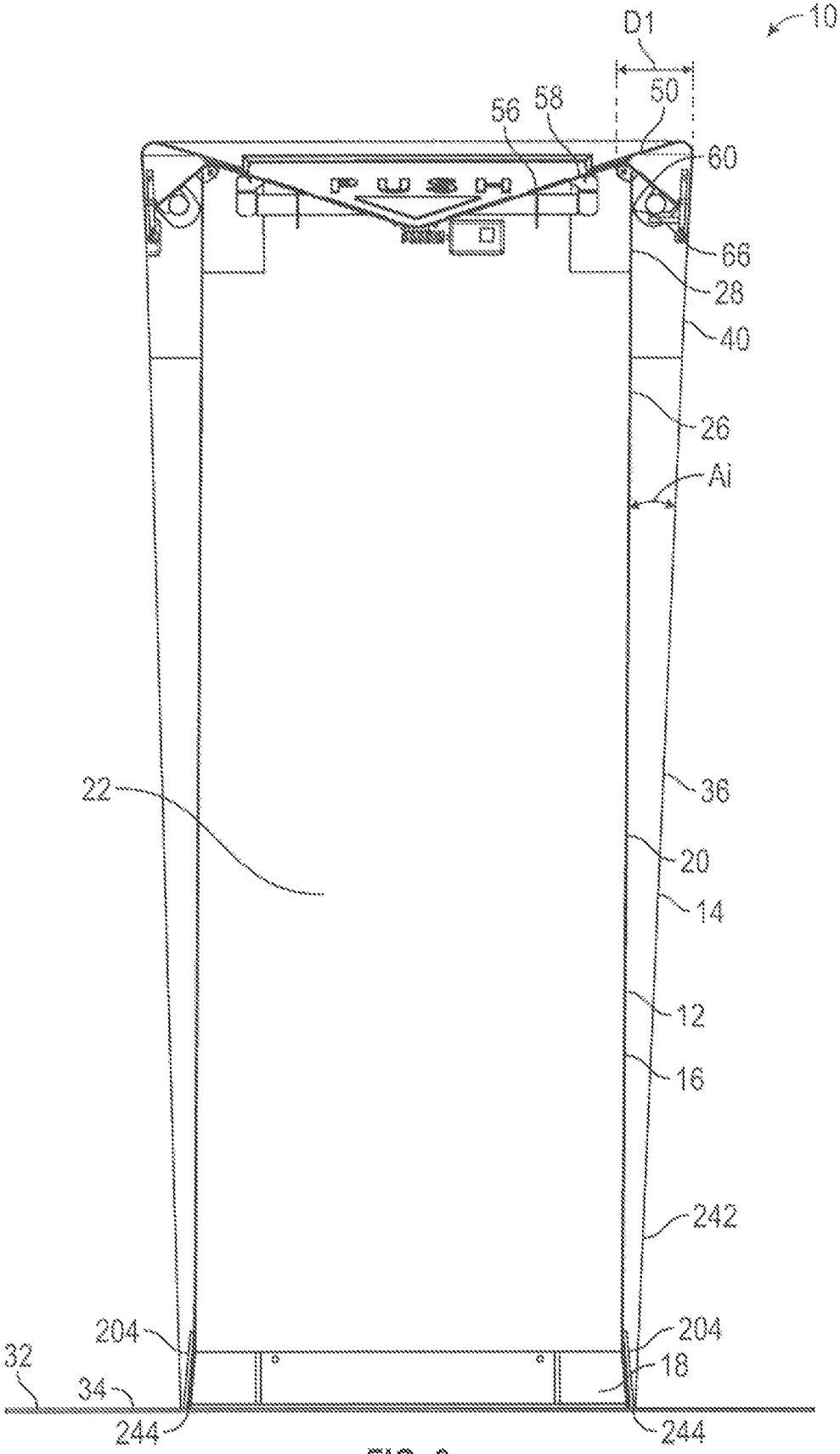
FIG. 8 is a cross-sectional view of the closed waste container shown in FIG. 1 along vertical section line 8-8' in FIG. 5.
Figure 8A:
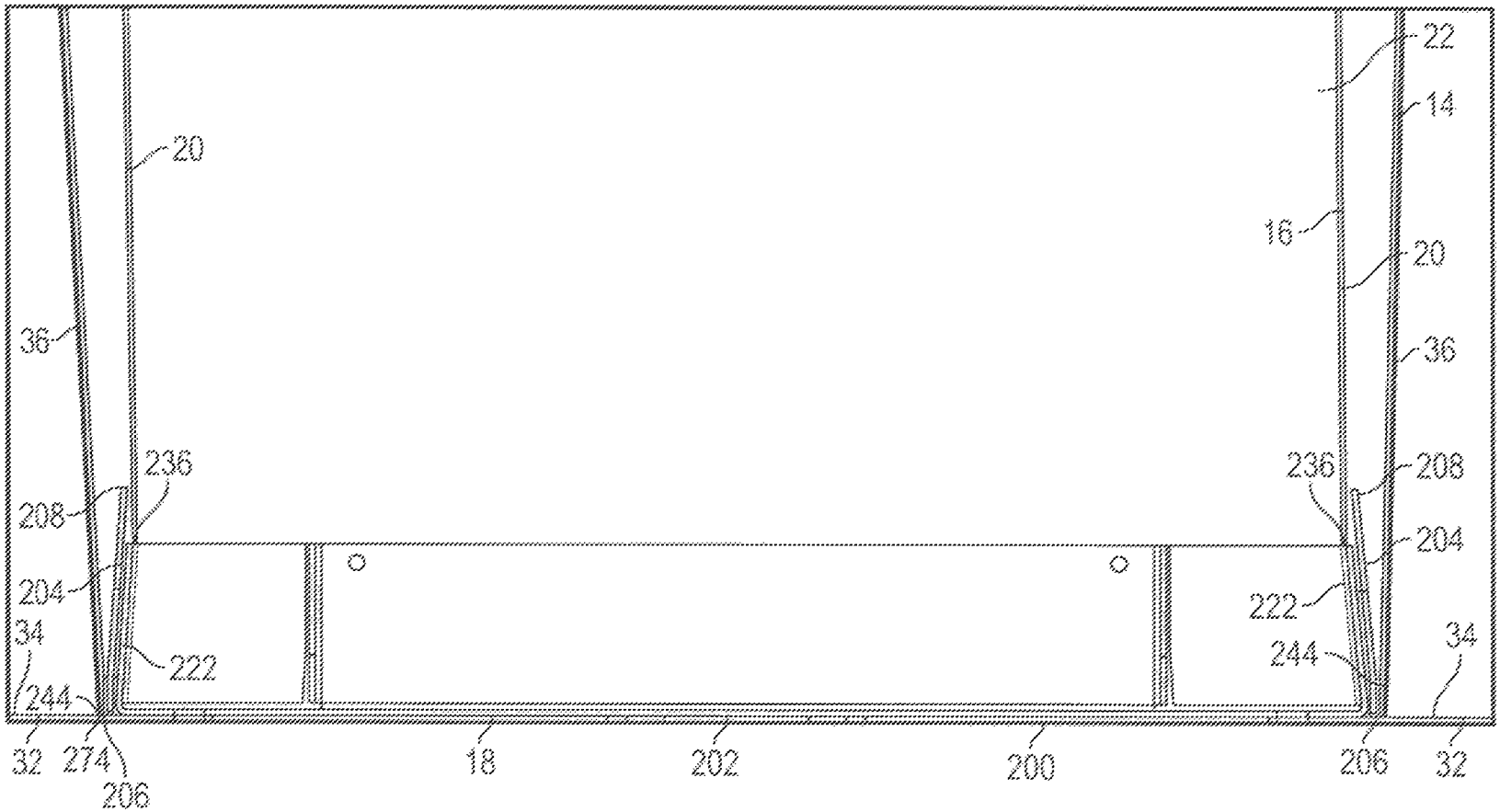
FIG. 8*a* is an enlarged view of the lower center portion of the cross-sectional view shown in FIG. 8.

The open bottom end 42 of the shroud 14 is configured to receive the bin 16 and the mounting guides 204 into the hollow interior cavity 44 when in the assembled state shown in FIG. 1. When in the assembled state, the bottom pivot edge 244 of each sidewall 36 rests on the support surface 34 of the mounting bracket 18, and runs along the bottom edge 206 of a respective one of the mounting guides 204. There is no fixed mechanical connection between the support surface 34 and the shroud 14, which permits the shroud 14 to be tilted or lifted away from the support surface 34. Under the force of gravity and without any countervailing force, the four bottom pivot edges 244 sit squarely on the support surface 34, as shown in FIGS. 1, 8 and 8*a*.

The mounting guides 204 assist in aligning the shroud 14 with the bin 16 when being placed in the assembled state. In particular, the slight inward angle of the mounting guides 204 causes the top edges 208 of the mounting guides 204 to be spaced inwardly relative to the bottom pivot edges 244 of the shroud 14. This provides extra space for the open end 42 of the shroud body 242 to fit over the top edges 208 of the mounting guides 204, and thus makes it easier to fit the shroud 14 over the mounting guides 204. As the bottom pivot edges 244 move down past the top edges 208 of the mounting guides 204, the angle of the mounting guides 204 causes the extra space between the mounting guides 204 and the bottom pivot edges 244 to diminish. This restricts the freedom of movement of the shroud 14 so as to guide the bottom pivot edges 244 towards the bottom edges 206 of the mounting guides 204. When the bottom pivot edges 244 reach the support surface 34 and are sitting squarely thereon, they are each positioned immediately adjacent to the bottom edge 206 of one of the mounting guides 204, as best seen in FIG. 8*a*.

This guiding function of the mounting guides 204 ensures that the shroud 14 is always positioned at approximately the same location relative to the bin 16 whenever the container 10 is in the assembled state and the bottom pivot edges 244 are sitting squarely on the support surface 34 under the force of gravity. In particular, when in the assembled state and in the absence of any countervailing forces, each sidewall 36 of the shroud 14 is equidistantly spaced from and squarely facing one of the outer walls 20 of the bin 16.

Figure 4:
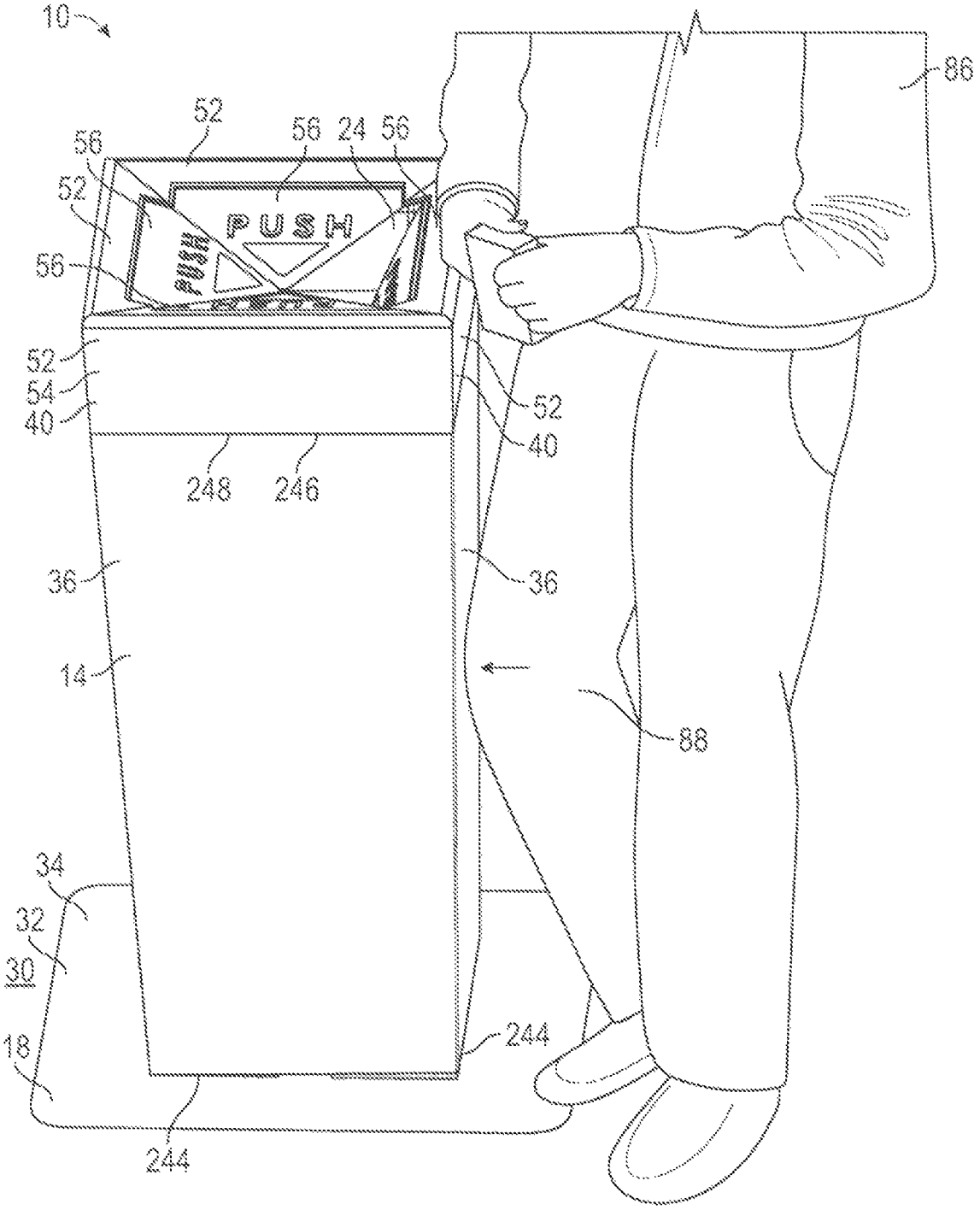
FIG. 4 is a perspective view of the waste container of FIG. 1, with a user shown placing the waste container in an open state by pressing his knee against the shroud and tilting the shroud towards the inner receptacle to open a lid panel of the waste container.
Figure 9:
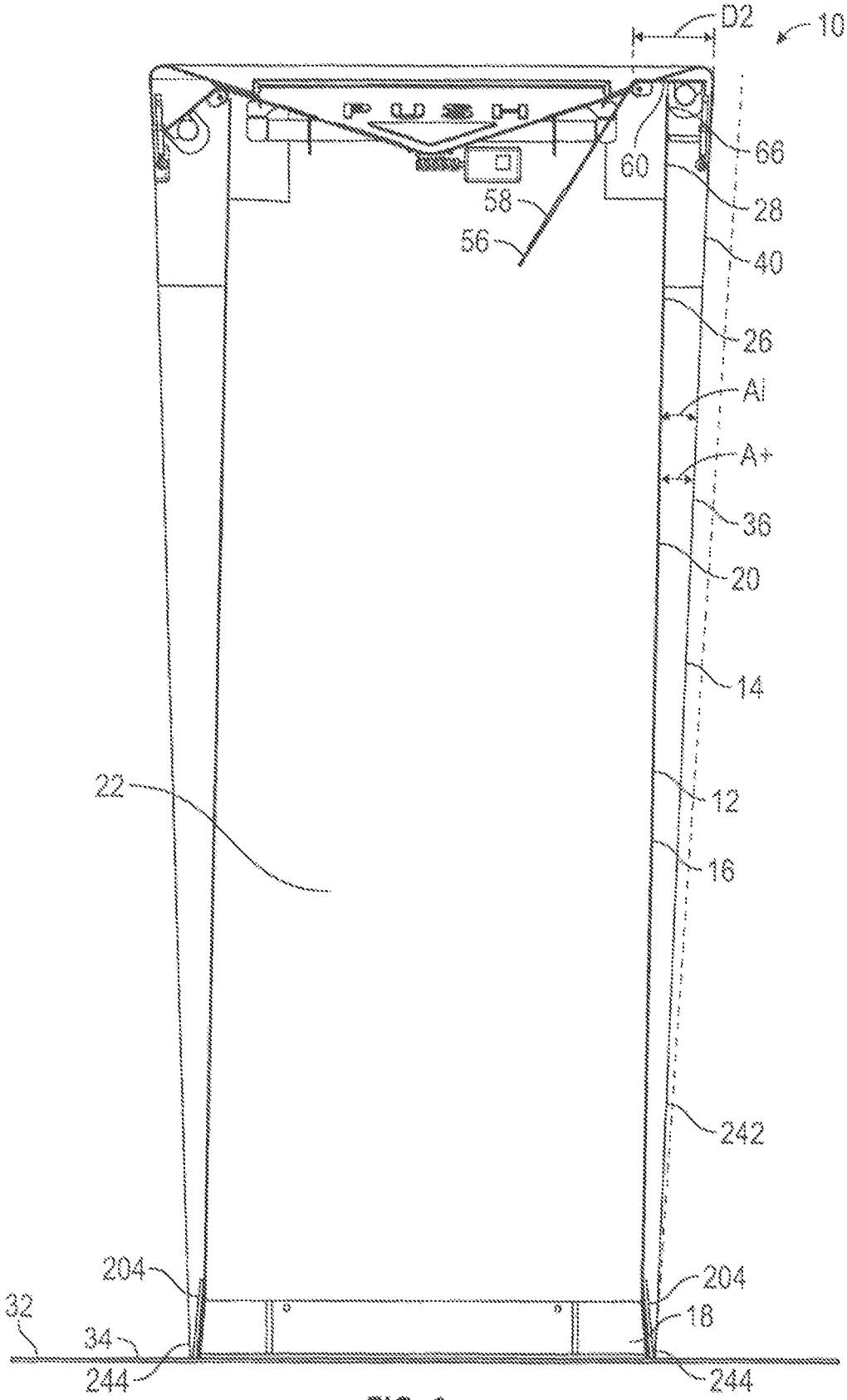
FIG. 9 is a cross-sectional view of the open waste container shown in FIG. 4, with the user omitted, along vertical section line 9-9' in FIG. 6.
Figure 9A:
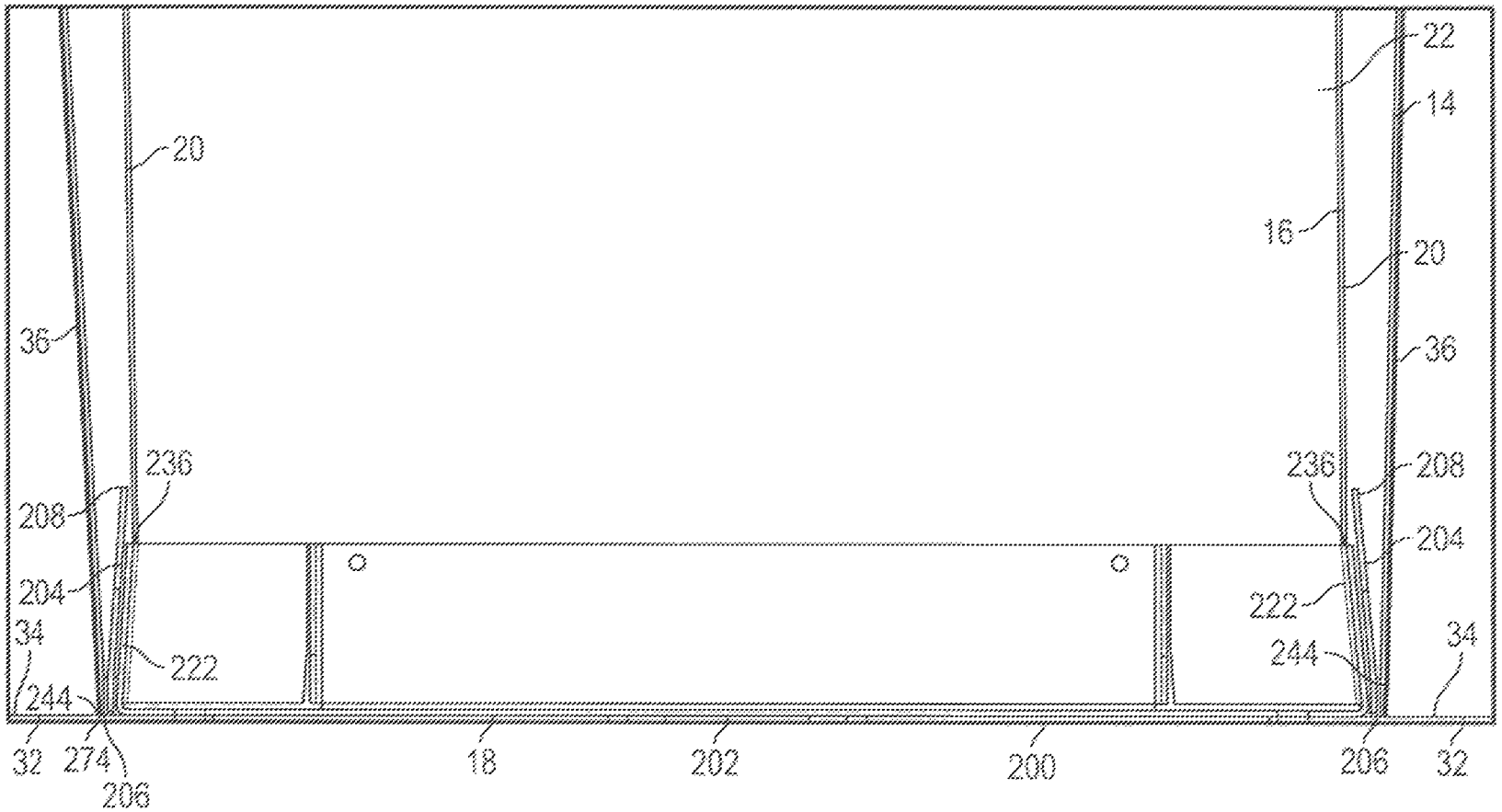
FIG. 9*a* is an enlarged view of the lower center portion of the cross-sectional view shown in FIG. 9.

The shroud 14 can also be tilted relative to the bin 16, as shown in FIGS. 4, 9, and 9*a*. This can be achieved by exerting a horizontal force to one of the sidewalls 36 or upper sidewalls 40 urging the sidewall 36 and upper sidewall 40 towards the bin 16. If the horizontal force is sufficient to overcome the force of gravity, the shroud 14 will tilt relative to the bin 16 by pivoting about an axis 274 defined by the bottom pivot edge 244 of the sidewall 36 opposite to the sidewall 36 that is being urged towards the bin 16. As the shroud 14 pivots about the axis 274, the bottom pivot edge 244 of the sidewall 36 that is being urged towards the bin 16 lifts away from the support surface 34, as best seen in FIG. 9*a*. The sidewall 36 also tilts towards the bin 16 from an initial angle $A_i$, measured relative to the outer wall 20, to a smaller tilted angle $A_t$, as shown in FIGS. 8 and 9. At the same time, the opposite sidewall 36 tilts away from the bin 16, with its bottom pivot edge 244 remaining in contact with the support surface 34. Any of the four sidewalls 36 can be tilted towards the bin 16 by applying the horizontal force to that sidewall 36. When the horizontal force is removed, the shroud 14 pivots about the pivot axis 274 in the opposite direction under the force of gravity until the bottom pivot edges 244 of all four sidewalls 36 again sit squarely on the support surface 34 outwardly of the mounting guides 204.

The tilting of the sidewalls 36 towards the bin 16 is facilitated by the slight inward angle of the mounting guides 204, which provides extra space for the sidewalls 36 to move towards the top edge 208 of the adjacent mounting guide 204. As can be seen in FIGS. 8 and 9, the sidewalls 36 likewise have a slight outward angle as they extend upwards from their respective bottom pivot edges 244. This also provides extra space for the sidewalls 36 to be tilted towards the bin 16.

The absence of a fixed mechanical connection between the shroud body 242 and the mounting bracket 18 permits the shroud 14 to be removed from the mounting bracket 18 by lifting the shroud 14 upwardly. When the shroud 14 is removed, as shown in FIG. 2, the open end 24 of the bin 16 is accessible to, for example, replace the garbage bag 300 placed within the inner chamber 22.

Preferably, the shroud head 54 is also removable from the shroud body 242, to provide access to the open end 24 of the bin 16 without requiring removal of the entire shroud 14. This is particularly useful for inspection and servicing of the three disclosed separate mechanisms to pivot the lid assembly. For example, the shroud head 54 may comprise a modular assembly which can be readily replaced on site as to replace a shroud head 54 that has one or more components not working with a working shroud head 54 or to replace a shroud head 54 with some features with a replacement shroud head 54 with different features or indicia. The upper support edges 246 of the sidewalls 36 may, for example, be releasably connected to the lower attachment edges 248 of the upper sidewalls 40 with a snap fit or a friction fit. Alternatively, removable screws, bolts, or other connectors could be used. In other embodiments of the invention, the sidewalls 36 and the upper sidewalls 40 may be integrally formed as a single unit, with the result that the shroud head 54 is not detachable from the shroud body 242. This may be preferred, for example, in embodiments of the invention in which the container 10 is relatively small, and where the entire shroud 14 can be removed from the mounting bracket 18 with relative ease. In addition to providing access to the open end 24 of the bin 16, making the shroud 14 and/or the shroud head 54 removable permits these components to be easily replaced without having to remove or replace the other components of the container 10.

The hinged connection of the lid panels 56 to the lid support bodies 50 permits the lid panels 56 to pivot about the horizontal axis 64 between a closed position and an open position. As shown in FIG. 1, when in the closed position the cover portions 58 of the lid panels 56 extend from their respective lid support bodies 50 over the open end 24 of the bin 16. When all four lid panels 56 are in the closed position, their cover portions 58 substantially cover the open end 24 of the bin 16. Each cover portion 58 is angled slightly downwards, so that the cover portions 58 form a funnel-like shape.

Figure 6:
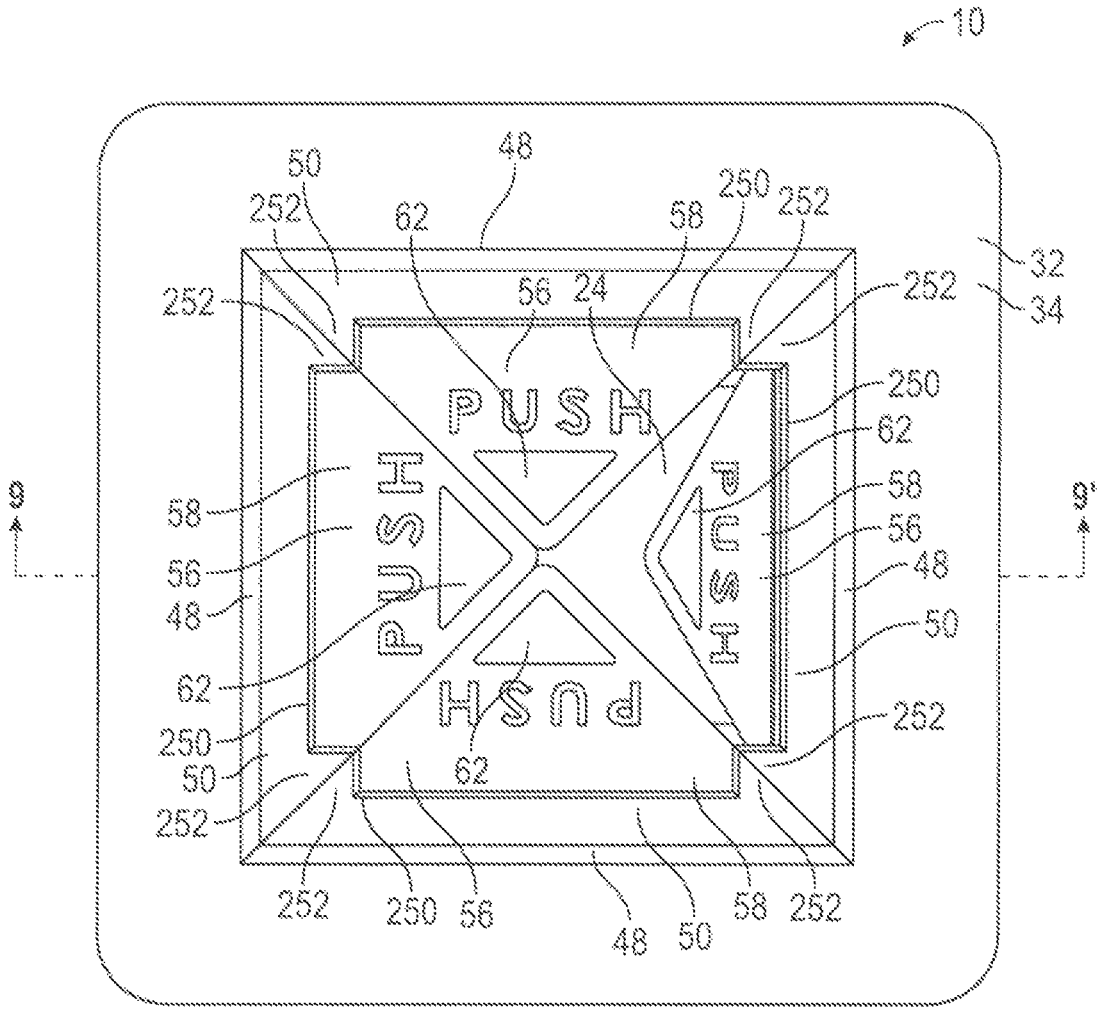
FIG. 6 is a top view of the open waste container shown in FIG. 4, with one of the lid panels shown in an open position.

As shown in FIG. 6, when one of the lid panels 56 pivots about the axis 64 to the open position, the cover portion 58 pivots downwards, towards the open end 24 of the bin 16. This pivoting moves the cover portion 58 away from the cover portions 58 of the other lid panels 56, thereby providing a passage through which waste materials can be deposited into the open end 24 of the bin 16.

As shown in FIG. 10, when the lid panel 56 is in the closed position, the actuation portion 60 extends downwardly from the inner edge 250 of the lid support body 50 into an actuation space 46 defined between the outer wall 20 of the bin 16 and the upper sidewall 40 of the shroud 14. When the lid panel 56 pivots about the axis 64 to the open position, the actuation portion 60 pivots upwards to the position shown in FIG. 13.

The counterweight 68 biases the lid panel 56 towards the closed position. In particular, the counterweight 68 pulls the actuation portion 60 downwards under the force of gravity, thereby pivoting the cover portion 58 upwards towards the closed position. The weight of the counterweight 68, in combination with the weight of the actuation portion 60, is selected to at least exceed the weight that would be required to counterbalance the weight of the cover portion 58, so that an additional countervailing force is required to overcome the bias towards the closed position. The stop tabs 258 on the cover portion 58 prevent the cover portion 58 from pivoting further upwards past the closed position under the weight of the counterweight 68 urging the actuation portion 60 straight downwards. In particular, when in the closed position the stop tabs 258 sit immediately under and engage with the hinge support extensions 252 of the lid support body 50. The engagement of the stop tabs 258 with the hinge support extensions 252 prevents the cover portion 58 from pivoting further upwards, and thus prevents the actuation portion 60 from pivoting further downwards under the force of gravity.

Figure 12:
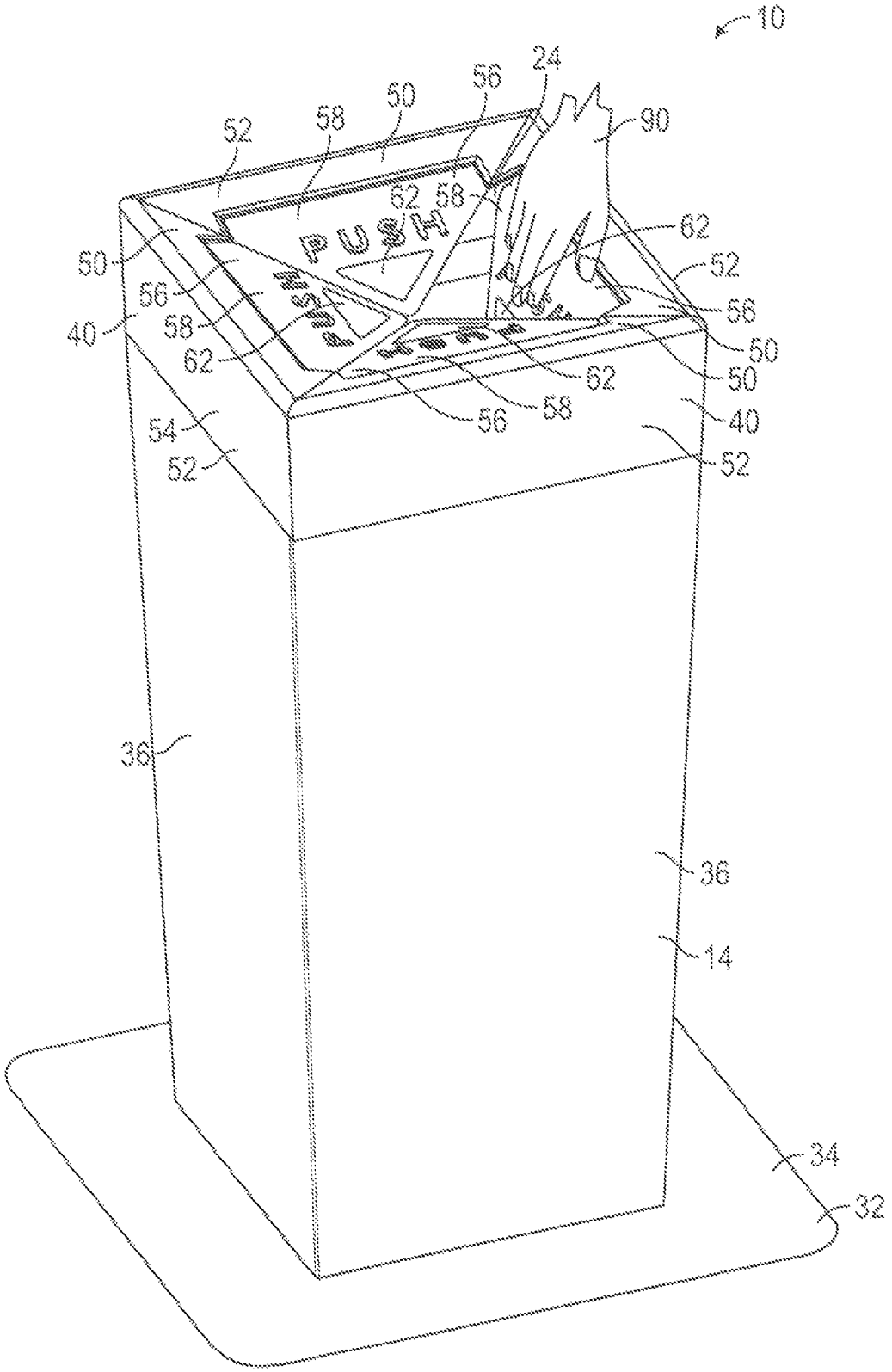
FIG. 12 shows a perspective view of the waste container shown in FIG. 1, with a user's hand shown opening the lid panel by manually depressing it.
Figure 13:
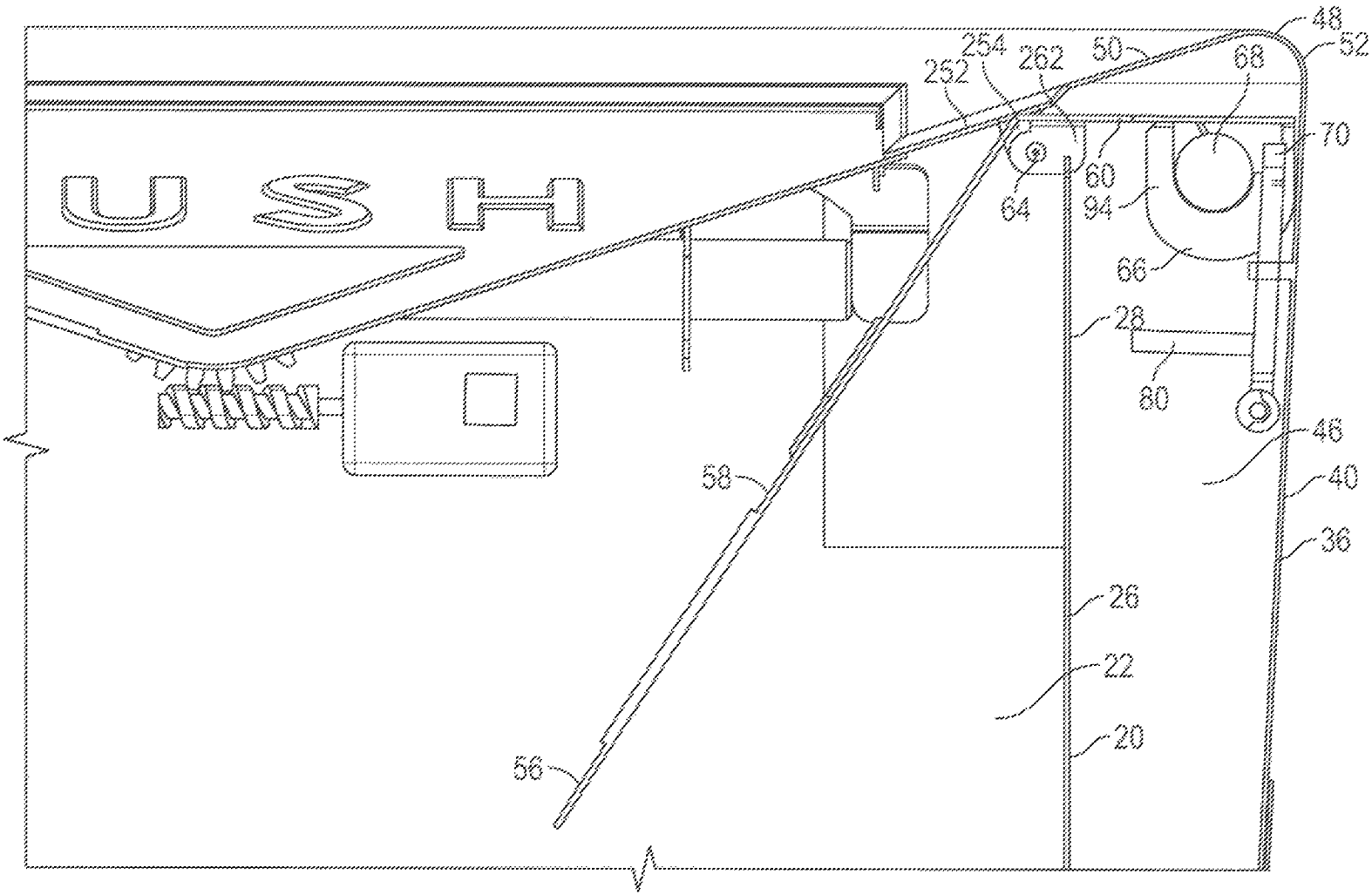
FIG. 13 shows a detailed cross-sectional view of the open waste container shown in FIG. 12, with the user's hand omitted.

The countervailing force required to pivot the lid panel 56 about the axis 64 from the closed position to the open position can be provided either by applying a downwards force to the cover portion 58, or an upwards force to the actuation portion 60. The downwards force can be provided, for example, by manually pressing the cover portion 58 downwards with the user's hand 90, as shown in FIGS. 12 and 13, or by placing a sufficiently heavy object on top of the cover portion 58. The downwardly angled lid support bodies 50 and lid panels 56 act as a collection funnel that directs dropped refuse towards the end points 260 of the panels 56, where, if heavy enough, the weight of the refuse will cause the panels 56 to open. If the refuse is not heavy enough to cause the panels 56 to open, then the panels 56 can be opened by applying a downwards force to the cover portions 58 with the user's hands 90. Larger objects can be deposited into the open end 24 of the bin 16 by simultaneously pivoting multiple lid panels 56 to their respective open positions, under the weight of the object or using the user's hands 90, to provide a larger passageway for the object to pass through. When the downwards force is removed, such as when the user's hand 90 is removed or when the object falls into the open end 24 of the bin 16, the lid panel 56 or lid panels 56 pivot back to the closed position under the weight of the counterweight 68.

Figure 16:
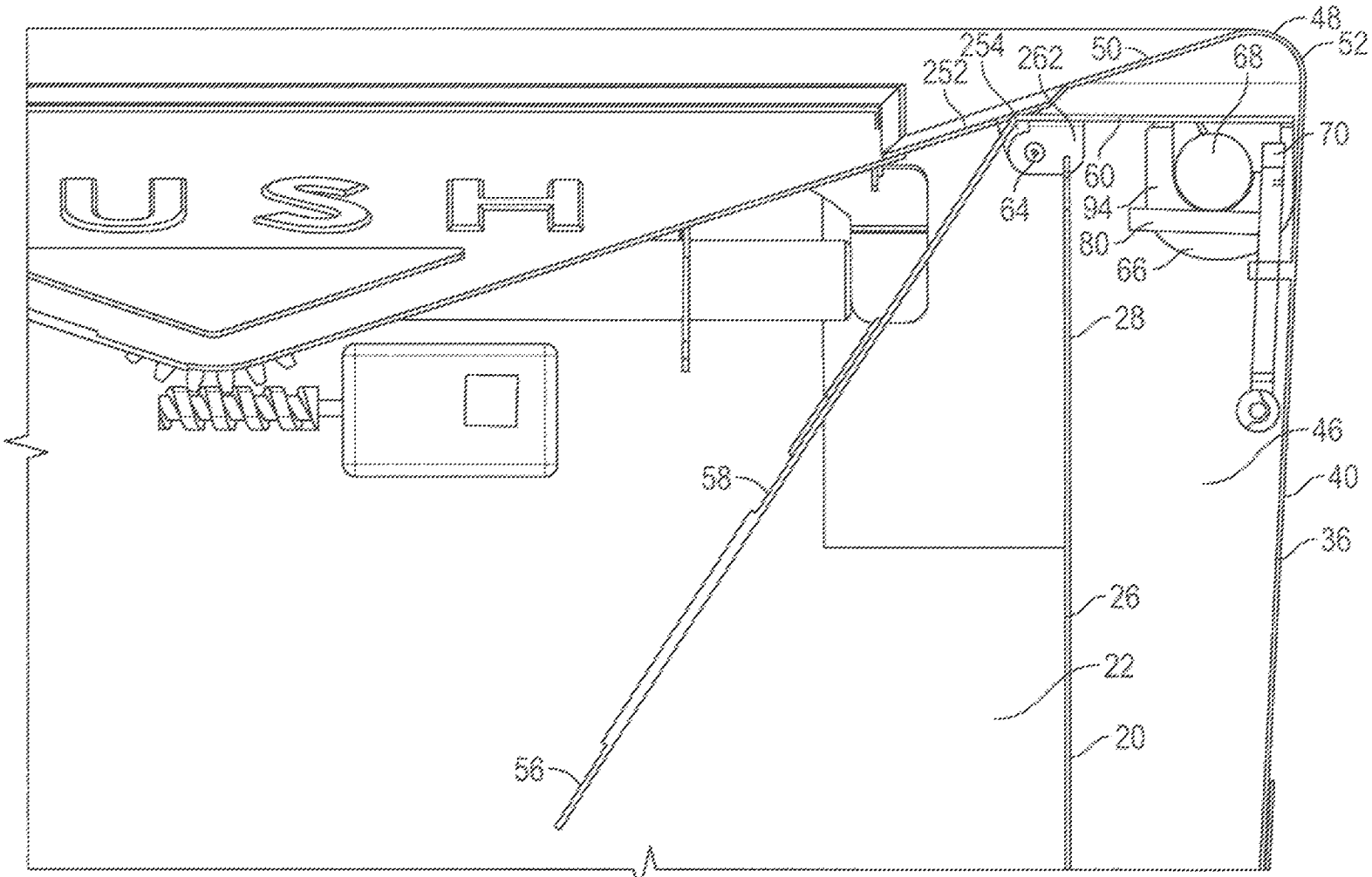
FIG. 16 shows a detailed cross-sectional view of the open waste container shown in FIG. 15, with the user's hand and the piece of paper omitted.
Figure 18:
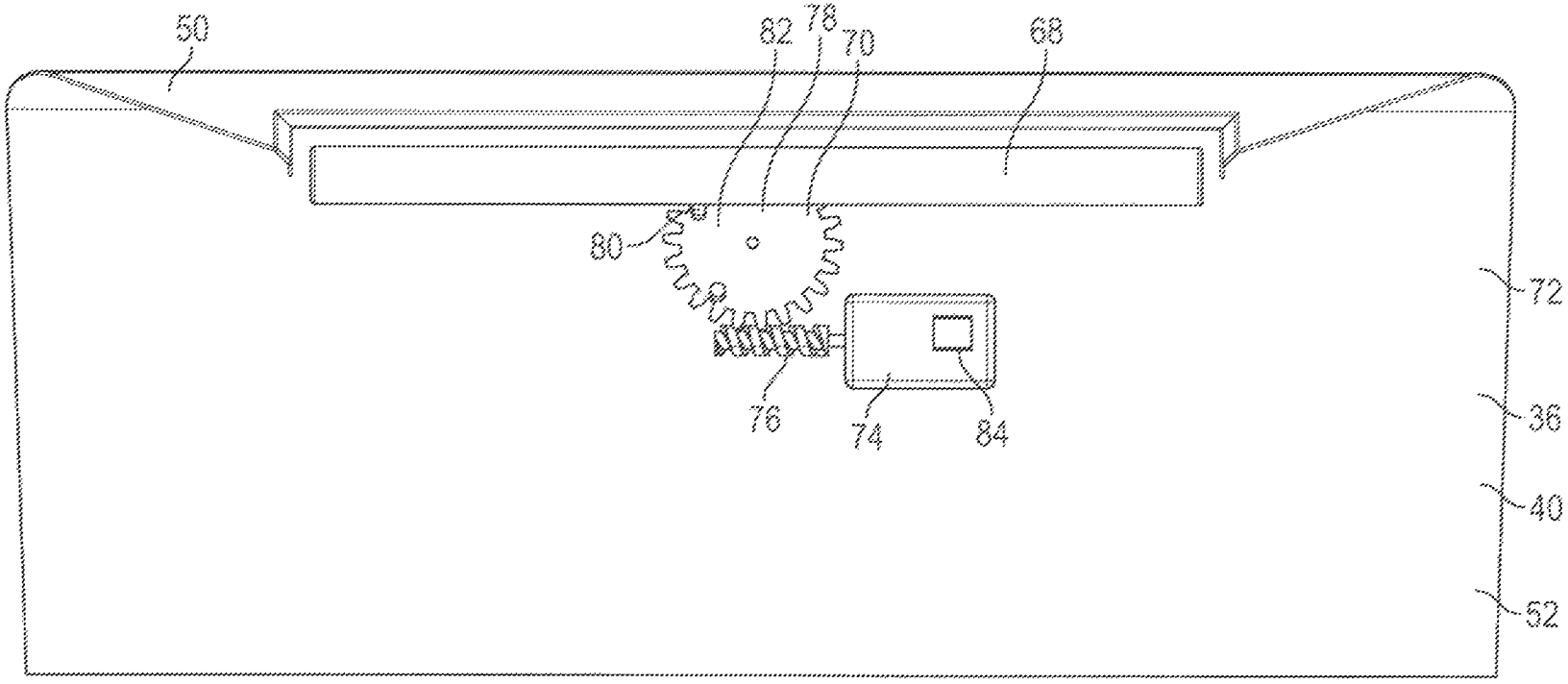
FIG. 18 shows the isolated view of the upper portion of the sidewall shown in FIG. 17, showing the lifting assembly in an activated position in which a pin of the lifting assembly has lifted the counterweight.

Alternatively, an upwards force can optionally be applied to the actuation portion 60 using the lifting assembly 70. As shown in FIGS. 10 and 17, the lifting assembly 70 is positioned on the inner surface 82 of the upper sidewall 40 so that the pin 80 extends under the counterweight 68. When activated, the motor 74 rotates the worm screw 76, which engages with and rotates the worm wheel 78. When the worm wheel 78 is rotated, the pin 80 moves upwards into engagement with the counterweight 68, as shown in FIGS. 16 and 18. This lifts the actuation portion 60 of the lid panel 56, pivoting the lid panel 56 about the axis 64 relative the lid support body 50 from the closed position to the open position. The controller 84 of the lifting assembly 70 is configured to maintain the lid panel 56 in the open position for a predetermined interval of time, after which the motor 74 rotates the worm screw 76 and the worm wheel 78 in the opposite direction. This lowers the pin 80 away from the counterweight 68, and allows the lid panel 56 to pivot back to the closed position under the weight of the counterweight 68.

The motor 74 may be configured to be activated by any desired signal or trigger. For example, although not shown, the container 10 could incorporate a button that activates the motor 74 when pressed. The container 10 could also incorporate one or more sensor mechanisms that activate the motor 74 when certain stimuli are detected. For example, the container 10 could incorporate motion sensors that activate the motor 74 when motion is detected near the container 10; time of flight sensors that activate the motor 74 when an object is detected in proximity to the container 10; light sensors that activate the motor 74 when a change in light condition is detected; or sound sensors that activate the motor 74 when certain sounds or voice commands are detected. In the embodiment that is shown, the solar panels 62 are used to activate the motor 74, as is described in more detail below.

The upwards force on the actuation portion 60 can also be provided by tilting the shroud 14 relative to the bin 16, as described above. In particular, when a horizontal force is applied to one of the sidewalls 36 to tilt the sidewall 36 towards the bin 16 from the initial angle $A_i$ shown in FIG. 8 to the tilted angle $A_t$ shown in FIG. 9, the attached upper sidewall 40 and lid support body 50 move inwardly from the first position shown in FIG. 10 to the second position shown in FIG. 11. This inwards movement reduces the distance between the upper sidewall 40 and the outer wall 20 from a first distance D1 to a reduced second distance D2, and causes the cam surface 66 of the actuation portion 60 of the lid panel 56 to move towards and engage with the camming surface 28 of the outer wall 20 of the bin 16. As the upper sidewall 40 and the lid support body 50 move further inwardly towards the second position, the engagement of the cam surface 66 with the camming surface 28 causes the actuation portion 60 to pivot upwards, thereby pivoting the lid panel 56 from the closed position to the open position. The cam surface 66 and the camming surface 28 thus provide an actuation mechanism 402 that effects movement of the lid panel 56 from the closed position to the open position upon movement of the sidewall 40 from the first position to the second position. When the horizontal force is removed, the shroud 14 returns to sitting squarely on the mounting bracket 18 under the force of gravity, and the sidewall 36 moves away from the outer wall 20 back to the initial angle $A_i$. This moves the cam surface 66 of the actuation portion 60 away and out of engagement with the camming surface 28 of the outer wall 20, allowing the lid panel 56 to pivot back to the closed position under the weight of the counterweight 68. Before disengaging from the camming surface 28, the cam surface 66 also biases the sidewall 36 towards the initial angle $A_i$ under the weight of the counterweight 68 pressing the cam surface 66 against the camming surface 28.

Figure 4A:
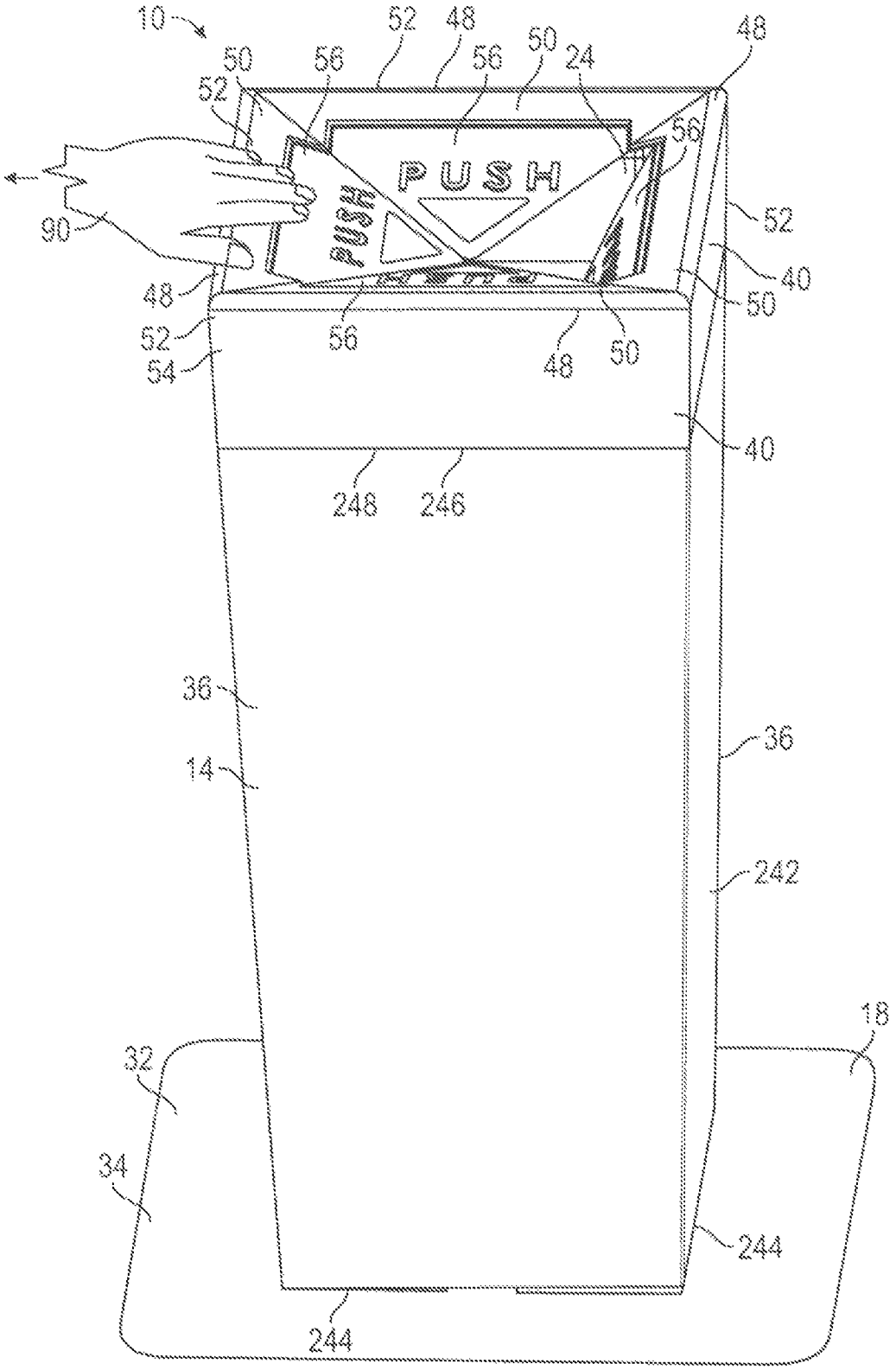
FIG. 4*a* is a perspective view of the waste container of FIG. 1, with a user's hand shown placing the waste container in an open state by pulling the shroud and tilting the shroud towards the inner receptacle to open a lid panel of the waste container.

The horizontal force can be applied by, for example, pressing a user's knee 88 against the sidewall 36, as shown in FIG. 4. Alternatively, the force could be applied by pushing or pulling the sidewall 36 with the user's hand 90 or another body part or object. For example, a user's hand 90 could be used to pull the shroud head 54 towards the user, as shown in FIG. 4*a*. This action tilts the sidewall 36 opposite the user towards the bin 16, causing the lid panel 56 opposite the user to pivot about the horizontal axis 64 from the closed position to the open position. Although the opening of only one lid panel 56 has been described and illustrated, any of the other three lid panels 56 could be opened in an analogous manner by tilting the shroud 14 towards the corresponding outer wall 20. This allows the container 10 to be operated from any of its four sides, thus increasing convenience for users.

The container 10 thus provides three separate mechanisms to pivot the lid panels 56 from the closed position to the open position, namely, by tilting the shroud 14 relative to the bin 16, by activating the lifting assembly 70, and by pushing downwards on the cover portion 58. The features of the container 10 that allow these three mechanisms to operate without interfering with one another include the fact that the cam surface 66 has no fixed mechanical connection to the camming surface 28, as can be seen in FIG. 13. This allows the cam surface 66 to move away from, and be mechanically disengaged from, the camming surface 28 when the lid panel 56 pivots to the open position. The lid panel 56 is thus able to pivot to the open position, such as by activating the lifting assembly 70 or by pushing downwards on the cover portion 58, without requiring the shroud 14 to be tilted relative to the bin 16.

Having multiple different ways to operate and access the container 10 increases convenience and assists users in interacting with the container 10 in accordance with their individual preferences and needs. For example, some users may prefer to operate the container 10 handlessly by tilting the shroud 14 using their knees 88, thus leaving their hands 90 free for other tasks such as operating a cell phone. Other users, such as users with limited mobility, may find it easier to open the lid panels 56 by activating the lifting assembly 70 or by simply pressing down on the cover portion 58.

In accordance with the present invention, the container may have only one of the three separate mechanisms to pivot the lid panels, however, two or more of the mechanisms may be provided, and since each mechanism does not interfere with the other, one or more may be provided and a second or third may readily be added or removed.

Figure 14:
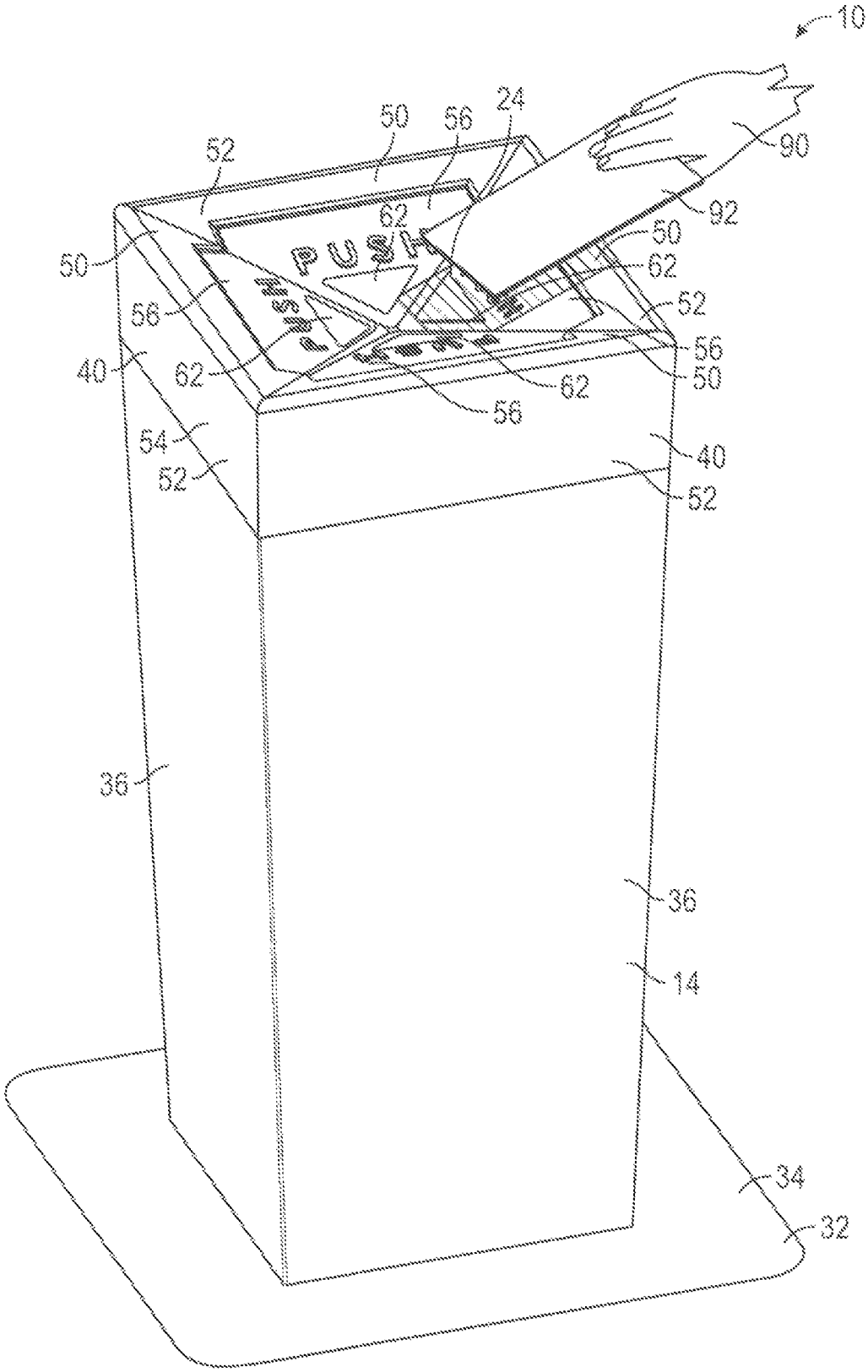
FIG. 14 shows a perspective view of the waste container shown in FIG. 1, with a user's hand holding a piece of paper over the lid panel so as to cast a shadow over a solar panel positioned on the lid panel.

In the embodiment shown, the lifting assemblies 70 are activated to pivot the lid panels 56 from the closed position to the open position by casting shade over the solar panels 62, as illustrated in FIGS. 14 to 18. The solar panels 62 are configured to generate electricity from a light source, such as sunlight through an open window or artificial light from an overhead light. When an object, such as the piece of paper 92 shown in FIG. 14, is placed over one of the solar panels 62, the amount of electricity that is generated by that solar panel 62 is reduced. The controller 84 is configured to detect this reduction, and to determine when the electricity generated by the solar panel 62 is reduced by a predetermined extent. This can be achieved, for example, by having the electricity that is generated by the solar panel 62 pass through the controller 84, so that the controller 84 is able to directly detect when the flow of electricity is reduced. Alternatively, a separate detection mechanism could be provided to detect reduced electricity generation and to relay this information to the controller 84.

Figure 15:
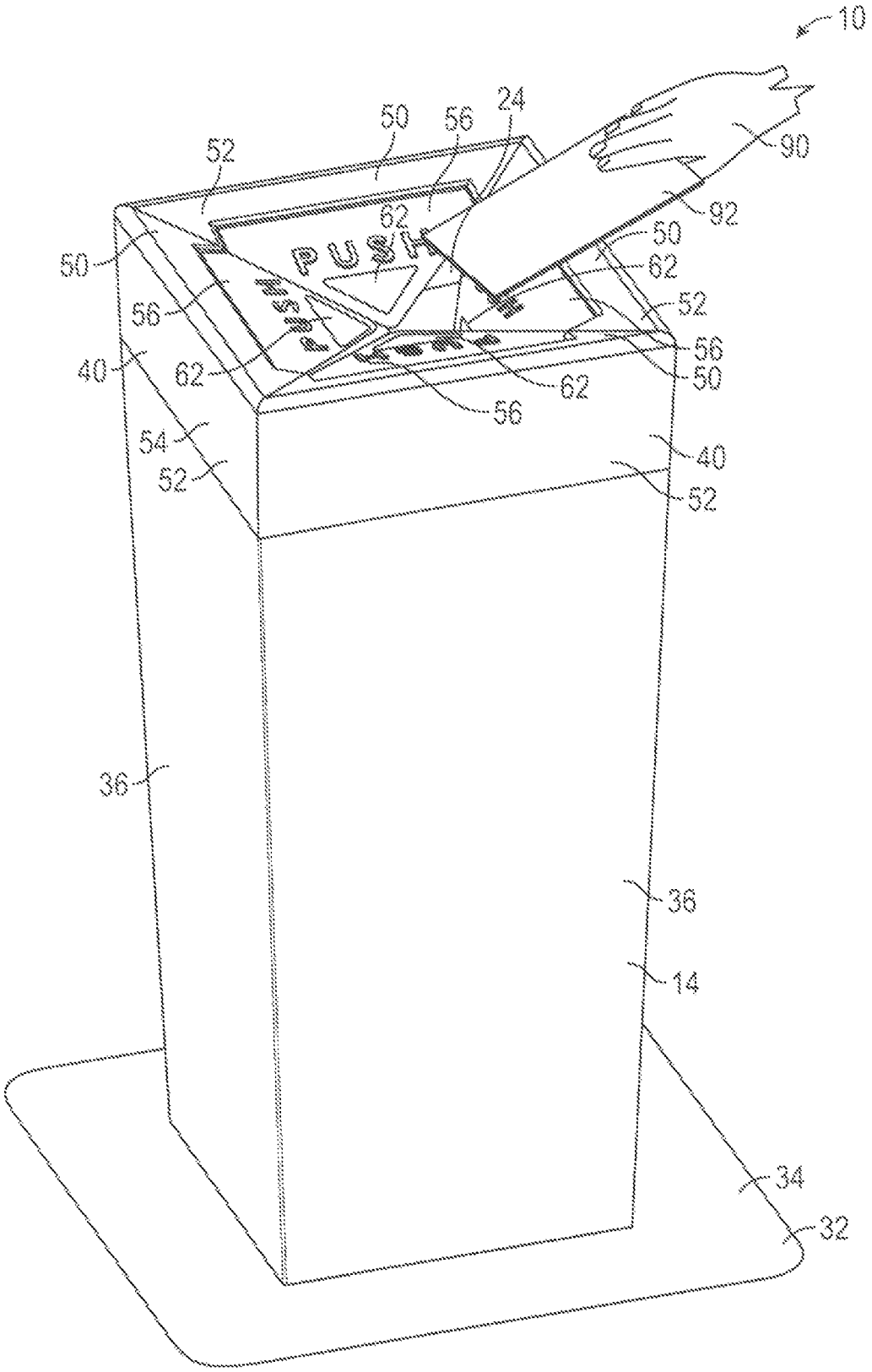
FIG. 15 shows a perspective view of the waste container shown in FIG. 14, with the lid panel in the open position.

When the controller 84 determines that the electricity generated by the solar panel 64 has been reduced by the predetermined extent, the controller 84 sends an activation signal to the motor 74. The motor 74 then effects rotation of the worm screw 76, which in turn rotates the worm wheel 78. This lifts the pin 80 upwards, into engagement with the counterweight 68. As the worm wheel 78 rotates, the counterweight 68 is lifted upwards, pivoting the lid panel 56 to the open position as shown in FIGS. 15 and 16. The paper 92 can then be deposited into the open end 24 of the bin 16.

The controller 84 is configured to hold the lid panel 56 open for a predetermined time period, after which the worm screw 76 is rotated in the opposite direction so that the pin 80 moves back down to the inactive position shown in FIG. 17. As the pin 80 moves downwards, the weight of the counterweight 68 pivots the actuation portion 60 downwards, returning the lid panel 56 to the closed position. The lid panel 56 can then be opened again by casting another shadow over the solar panel 62. Alternatively, any of the other three lid panels 56 can be opened by casting shade over their respective solar panels 62, in exactly the same manner as described above.

The features that allow the lifting assembly 70 to open the lid panel 56 without interfering with the other modes of opening the panel 56, namely tilting the shroud 14 and manually depressing the cover portion 58, are best seen in FIGS. 11 and 13. In particular, there is no fixed mechanical connection between the pin 80 and the actuation portion 60 of the lid panel 56. This allows the actuation portion 60 to move away from, and be mechanically disengaged from, the pin 80 when the lid panel 56 pivots to the open position while the lifting assembly 70 remains inactive. This allows the panel 56 to be opened while the lifting assembly 70 remains inactive.

The predetermined extent by which the electricity generated by the solar panel 62 must be reduced in order to activate the motor 74 is selected so as to adequately distinguish between instances in which an object has actually been placed over the solar panel 62, and instances in which there has been some other change in lighting that is unrelated to the operation of the container 10, such as a change in weather. One way to improve the accuracy of this determination is by making the predetermined extent dependent on the amount of electricity that is generated by the other solar panels 62. When placed at the location shown in FIG. 14, the piece of paper 92 casts a shadow over one of the solar panels 62, but the other three solar panels 62 are at least partially unshaded. As such, a decrease in the electricity generated by one of the solar panels 62 relative to the other solar panels 62 can serve as a useful indication that an object, such as the piece of paper 92, has been placed over the solar panel 62 whose electricity output is reduced. In contrast, a reduction in the electricity generated by all of the solar panels 62 might indicate that there has been a change in lighting that is unrelated to the operation of the container 10, such as a cloud moving in front of the sun. The predetermined extent could, for example, be set at a 10%, 25%, or 50% reduction in electricity generated by one solar panel 62 relative to one or more of the other solar panels 62.

In embodiments of the invention in which the predetermined extent for each solar panel 62 is dependent on the electricity generated by one or more of the other solar panels 62, it is useful for the four controllers 84 to be connected to one another. This allows the controllers 84 to share information about the electricity generated by their respective panels 62, so that the predetermined extent can reflect that information. Alternatively, a separate detection mechanism could be used to detect the electricity generated by all of the panels 62, and relay this information to all of the controllers 84. The four controllers 84 could also be replaced by, or made subservient to, a master control system that receives information about the electricity generated by all of the panels 62 and controls all of the motors 74.

The master control system could, for example, send a first activation signal to a first one of the motors 74 when the electricity generated by a first solar panel 62 is reduced by the predetermined extent; send a second activation signal to a second one of the motors 74 when the electricity generated by a second solar panel 62 is reduced by the predetermined extent; send a third activation signal to a third one of the motors 74 when the electricity generated by a third solar panel 62 is reduced by the predetermined extent; and send a fourth activation signal to a fourth one of the motors 74 when the electricity generated by a fourth solar panel 62 is reduced by the predetermined extent.

In some embodiments of the invention, the master control system could be configured to send a fifth activation signal to all of the motors 74 in certain circumstances, so that all of the lid panels 56 are opened simultaneously. This could be done, for example, if after having sent the first, second, third, or fourth activation signals, the electricity generated by the respective solar panel 62 remains reduced. This would occur if the object to be placed in the bin 16 is too large to fit into the passage that is provided by opening a single lid panel 56. For example, a large piece of paper 92 that is deposited onto one of the lid panels 56 might not fit through the passage that is provided when the panel 56 opens, and also might not have enough weight to open the other panels 56. In these circumstances, opening all of the lid panels 56 simultaneously by sending the fifth activation signal to all of the motors 74 would allow the paper 92 to fall into the bin 16.

In other embodiments of the invention, the solar panels 62 could be omitted altogether. Instead, the lifting assembly 70 could be activated by other kinds of sensors, such as motion sensors, time of flight sensors, infrared sensors or the like, which are configured to detect the presence of a user, a user's hands 90, or any other stimuli indicating that the container 10 is in use. The solar panels 62 could also be configured so as not to generate electricity, but rather to merely generate a signal that is indicative of the amount of light that is falling on the panels 62. The signal could then be used by the controller 84 to control activation of the lifting assembly 70 based on the amount of light that is detected.

In addition to providing a container and a construction for various components and aspects of the container, the present invention provides methods of operation of a container as have been disclosed herein. For example, the invention provides a method for controlling the opening of selected of the movable panels 56 by monitoring of the output of one or a plurality of the solar panels 62 on the panels 56 in a container with panels 56 as disclosed in the preferred embodiments. As well, this method is not limited to use on containers having the construction of the preferred embodiments disclosed but rather is useful in any arrangement where one or more panels are movable between open and closed positions for various purposes.

Reference is now made to FIGS. 19 to 22, which show a waste container 10 in accordance with a second embodiment of the invention. This embodiment is generally similar to the embodiment described above, with the exception that the container 10 has a single edge cap 52, and does not have a removable shroud 14. Like numerals are used to identify like features.

Figure 21:
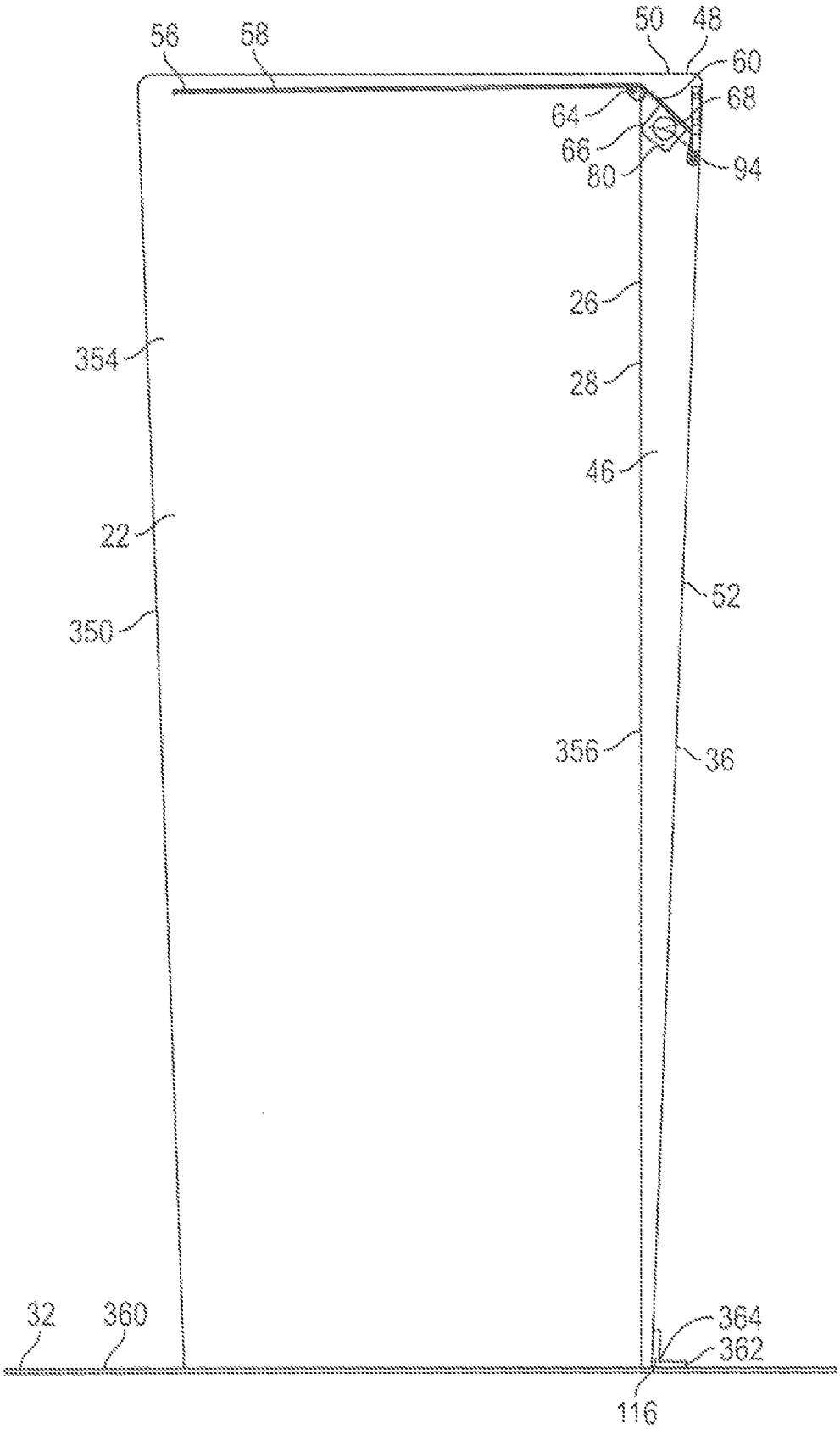
FIG. 21 is a cross-sectional view of the waste container shown in FIG. 19 along section line A-A' in FIG. 19.

In this embodiment, in place of the inner receptacle 12 and the outer shroud 14, the container 10 has a unified receptacle body 102 and a movable edge cap 52. The receptacle body 102 has three outer sides 350, 352, 354 and one inner side 356. The inner side 356 is best seen in FIG. 21. The inner side 356 faces and is spaced from a first one of the outer sides 350. The remaining two outer sides 352, 354 extend perpendicularly from respective corner edges 358 of the first outer side 350. The inner side 356 extends between the two outer sides 352, 354, and is spaced inwardly from the corner edges 358 of the two outer sides 352, 354. The inner side 356 has an outwardly facing surface 26 that serves as a camming surface 28 during operation of the container 10. Together, the inner side 356 and the outer sides 350, 352, 354 define an inner chamber 22 with an open upper end 24 for receiving waste materials. The outer sides 350, 352, 354 and the inner side 356 are rigidly mounted to a mounting plate 360, which is configured to be rigidly mounted to a floor surface 30. The mounting plate 360 has a flat foot portion 32 that extends circumferentially outwardly from the unified receptacle body 102.

The edge cap 52 has a generally vertical sidewall 36 and a generally horizontal lid support body 50. Unlike in the previous embodiment, the sidewall 36 is a single unified structure, and does not have a removable upper portion. The sidewall 36 has a lower edge 116 that is hingedly secured to the foot portion 32 of the mounting plate 260 by two barrel hinges 362. The hinges 362 allow the sidewall 36 to pivot relative to the foot portion 32 about a horizontal hinge axis 364 defined by the barrels of the hinges 362.

Figure 19:
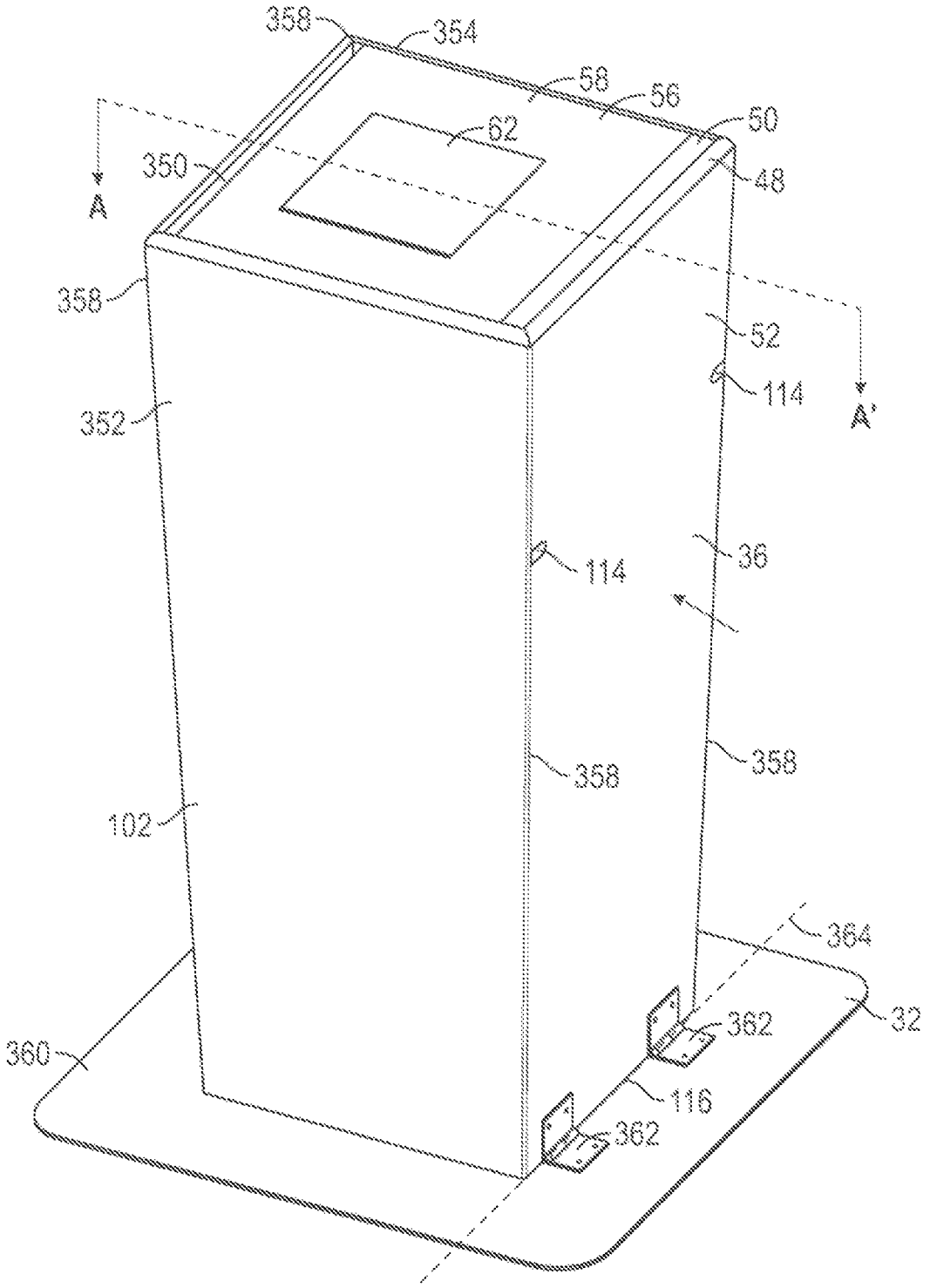
FIG. 19 is a perspective view of a waste container in accordance with a second embodiment of the present invention, with a lid panel of the waste container shown in a closed position.
Figure 20:
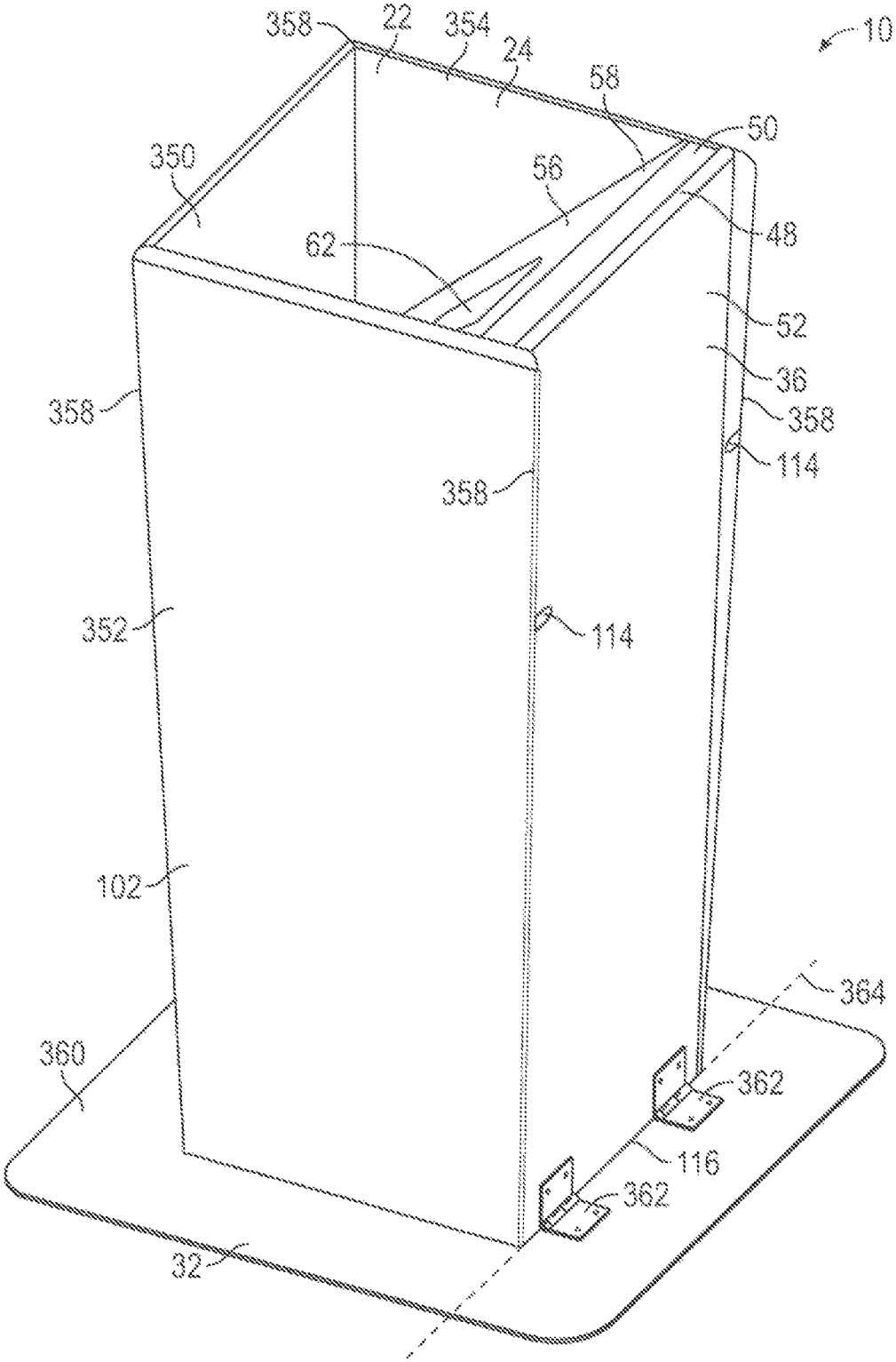
FIG. 20 is a perspective view of the waste container shown in FIG. 19, with the lid panel shown in an open position.

The sidewall 36 extends up from the lower edge 116 to an upper corner edge 48. The upper corner edge 48 is integrally connected to the inwardly projecting lid support body 50. The lid support body 50 hingedly supports a lid panel 56 in the same manner as in the previous embodiment, so that the lid panel 56 is pivotable about an axis 64 between a closed position, as seen in FIG. 19, and an open position, as seen in FIG. 20. As in the previous embodiment, the lid panel 56 has a cover portion 58 and an actuation portion 60. The cover portion 58 has a generally square shape, and is much larger than in the previous embodiment, so as to substantially cover the entire open end 24 of the receptacle body 102 when in the closed position. The cover portion 58 incorporates a solar panel 62, which generates electricity from a light source.

As in the previous embodiment, the actuation portion 60 incorporates a cam surface 66 and a counterweight 68. The counterweight 68 is heavier in this embodiment, so as to bias the larger cover portion 58 towards the closed position. The actuation portion 60 is otherwise identical to the previous embodiment.

The sidewall 36 faces and is spaced from the inner side 356 of the receptacle body 102, so as to define an actuation space 46 there between. The lid support body 50 extends horizontally inward over the actuation space 46 towards the open end 24 of the receptacle body 102. When in the closed position, the cover portion 58 of the lid panel 56 extends horizontally inwards over the open end 24 of the receptacle body 102, and the actuation portion extends downwardly outwards into the actuation space 46. When the lid panel 56 pivots about the axis 64 from the closed position to the open position, the cover portion 58 pivots downwardly into the open end 24 of the receptacle body 102, thereby providing a passage for depositing refuse into the inner chamber 22, and the actuation portion 60 pivots upwardly to the generally horizontal position shown in FIG. 22.

Figure 22:
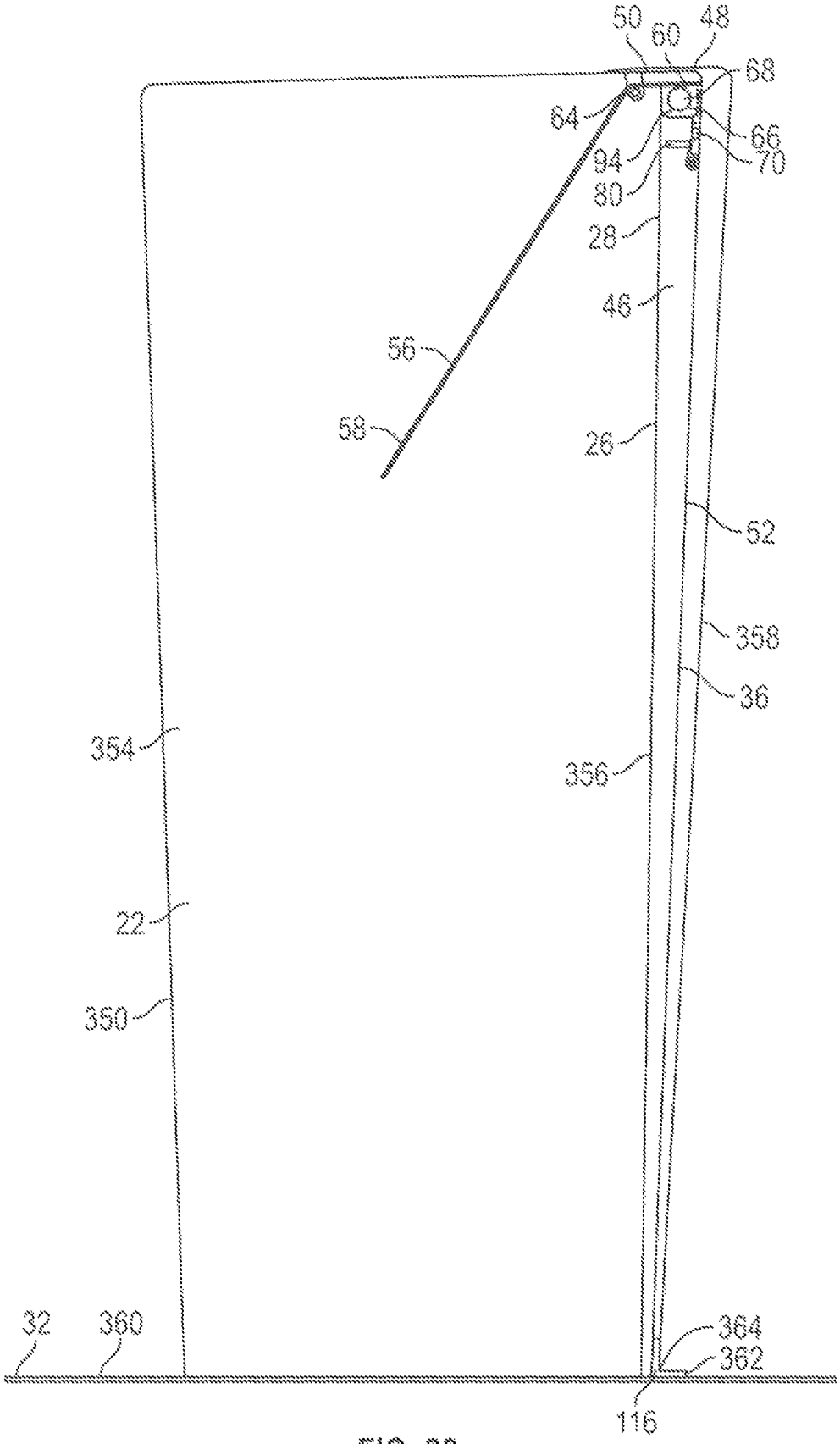
FIG. 22 is a cross-sectional view of the waste container shown in FIG. 20 along section line A-A' in FIG. 19.

The sidewall 36 is pivotable about the hinge axis 364 between a first location, shown in FIGS. 19 and 21, in which the sidewall 36 extends between the corner edges 358 of the two outer sides 352, 354 of the receptacle body 102, and a second location, shown in FIGS. 20 and 22, in which the sidewall 36 is tilted inwardly from the corner edges 358 of the two outer sides 352, 354. The sidewall 36 can be pivoted from the first location to the second location by applying a horizontal force to the sidewall 36 above the lower edge 116, such as by pushing a user's hand or knee against the sidewall 36.

As in the previous embodiment, the lid panel 56 can be pivoted from the closed position to the open position by tilting the sidewall 36 towards the camming surface 28. In particular, when the sidewall 36 pivots towards the second location, the cam surface 66 of the actuation portion 60 engages with the camming surface 28, in exactly the same manner as in the previous embodiment. This engagement pivots the actuation portion 60 upwards, pivoting the lid panel 56 from the closed position to the open position.

The biasing force for returning the sidewall 36 to the first location from the second location, once the horizontal force is removed, is provided by the counterweight 68. In particular, the weight of the counterweight 68 presses the cam surface 66 against the camming surface 28 such that, in the absence of a countervailing force, the sidewall 36 pivots away from the camming surface 28 towards the first position. This allows the counterweight 68 to pivot downwards, pivoting the lid panel 56 from the open position to the closed position. Two tabs 114 extending behind the sidewall 36 from the corner edges 358 of the outer sides 352, 354 prevent the sidewall 36 from pivoting outwardly past the corner edges 358.

As in the previous embodiment, the edge cap 52 has a lifting assembly 70 mounted on an inside surface 72 of the sidewall 36. The lifting assembly 70 is identical to the lifting assembly 70 as described and illustrated in respect of the previous embodiment.

In addition to tilting the sidewall 36 towards the camming surface 28, the panel 56 can also be opened by manually depressing the cover portion 58 of the panel 56 or by activating the lifting assembly 70, as in the previous embodiment. The lifting assembly 70 may be activated by casting a shadow over the solar panel 62. Since there is only one solar panel 62 in the embodiment shown in FIGS. 19 to 22, the predetermined extent by which the generated electricity must be reduced to trigger the lifting assembly 70 is not based on the electricity generated by other solar panels 62. Instead, the predetermined extent depends only on the electricity generated by the one solar panel 62, and could, for example, be set at a 25%, 50%, or 75% reduction in generated electricity over a given time period, such as one or two seconds. Otherwise, the lifting assembly 70 operates in an identical manner as in the previous embodiment shown in FIGS. 1 to 18.

Although two exemplary containers 10 have been described in detail above, it is to be appreciated that any alternative constructions that operate in an analogous manner could be used instead. For example, a construction in which the bin 16 is replaced with a flexible bag could be used instead. In this case, the camming surface 28 could, for example, take the form of a wall or a post that is mounted to the floor surface 30 in proximity to the bag. The bag could, for example, be held in place by a wire frame that is attached to or mounted beside the camming surface 28. Additional components could also be added, such as a grate or plate positioned over the lid panels 54 to prevent oversized objects from being inserted into the container 10.

The edge cap 52 could be movably supported relative to the camming surface 28 using any suitable mechanism, and is not limited to the free tilting and hinged embodiments described herein. For example, the edge cap 52 could be slidably mounted relative to the inner receptacle 12 using a system of rails or tracks to allow the edge cap 52 to move between the first and second locations. The container 10 could also be opened in other ways than those described above. For example, the shroud 14 could be tilted to open the lid panel 56 by pushing a wheel chair into the sidewall 36, or by pushing the sidewall 36 with the user's hands 90. In some embodiments, a foot pedal can be placed at the bottom of the shroud 14 to lift and tilt the shroud 14 when the foot pedal is depressed.

The electricity generated by the solar panel 62 is preferably used to power the motor 74, so that no external power source is required. The generated electricity could, for example, be used to charge a rechargeable battery that provides power to the motor 74. In some embodiments, the battery is used as the counterweight 68, thereby saving space and eliminating the need for a separate counterweight 68.

The actuation portion 60 of the lid panel 56 need not have the construction shown in the drawings, in which the cam surface 66 is provided as a U-shaped support for the counterweight 68. Rather, any suitable construction that provides a cam surface 66 for pivoting the panel 56 from the closed position to the open position upon engagement with the camming surface 28 could be used instead. Nor is it necessary for the actuation portion 60 to include a distinct counterweight 68. Instead, the actuation portion 60 itself could be provided with a sufficient weight so as to bias the lid panel 56 towards the closed position. Other mechanisms different from those described in the exemplary embodiments could also be used to effect movement of the lid panel 56 from the closed position to the open position based on changes in the spacing between the sidewall 36 and the bin 16. For example, in place of the cam surface 66 and the camming surface 28, the container 10 could incorporate magnets that effect movement of the lid panel 56 from the closed position to the open position when the sidewall 36 is moved towards the bin 16.

Though the described embodiments have shown the container 10 as for mounting on a floor surface 30, some embodiments of the invention could instead be mounted to a wall or other vertical surface. For example, the container 10 shown in FIGS. 19 to 22 could be adapted for mounting to a wall, with the edge cap 52 positioned away from the wall for user access.

In some embodiments, the container 10 is useful for providing protection against explosive devices that may be deposited into the container 10. For example, in the embodiment shown in FIG. 1, the inner receptacle 12 provides a rigid enclosure that would direct an explosive blast upwards, thus limiting the potential damage to people and property in the area. This protection could be further enhanced by providing the receptacle 12 with strong, reinforced outer walls 20. The double-walled construction, with both an inner receptacle 12 and an outer shroud 14, also helps to offer additional protection against an explosive blast. Furthermore, since the outer shroud 14 is easily removable from the inner receptacle 12 to gain access to a garbage bag 300 carried therein, this enhanced protection does not come at the expense of making it more difficult to empty the container 10.

Although the exemplary embodiments have shown the container 10 as including four and one lid panels 56, respectively, the container 10 could be adapted to incorporate a different number of panels 56 if desired. The container 10 could, for example, have two lid panels 56 and be tiltable in only two directions. The lid panels 56 need not have the shape and configuration shown in the drawings, and could, for example, have a rectangular shape instead. Nor do the lid panels 56 need to incorporate solar panels 62. The solar panels 62 could, for example, be provided on the lid support body 50 instead, or could be omitted altogether.

The lifting assembly 70 need not be triggered exclusively by casting shade over the solar panels 62. For example, the container 10 could incorporate a button that activates the lifting assembly 70 when pressed. The lifting assembly 70 could also be omitted altogether in some embodiments.

The described mechanism of using solar panels 62 to trigger the opening of a barrier, such as the lid panel 56, need not be limited exclusively to the context of waste containers 10 as described above. Rather, the same or an analogous mechanism could be used to open any kind of barrier in which casting a shadow serves as a useful trigger. For example, a solar panel 62 could be installed on a gate, a door, a mailbox, or the like to serve as a trigger for opening when a shadow is cast over the panel 62.

The invention could also be used with other types of containers 10 besides waste containers 10, such as storage boxes, toy boxes, and shipping containers.

The term "controller" as used herein can refer to a collection of components that control the activation of the lifting assemblies 70. The term could, for example, refer to a group of separate electronic components that independently control each lifting assembly 70, or a single electronic component that controls all of the lifting assemblies 70.

The term "mechanical actuator" as used herein can refer to a group of separate mechanical structures that are operable to open and/or close one or more lid panels 56, flaps, or barriers. The term could, for example, refer to a group of separate motors that independently effect movement of several different lid panels 56, or to a single motor that effects movement of one or more panels 56.

Although this disclosure has described and illustrated certain preferred embodiments of the invention, it is to be understood that the invention is not restricted to these particular embodiments. Rather, the invention includes all embodiments which are functional, electrical or mechanical equivalents of the specific embodiments and features that have been described and illustrated herein.

I claim:

1. A container comprising:

a receptacle with an open upper end for receiving material;

a lid that is movably supported relative to the receptacle, the lid being movable between a closed condition, in which the lid at least partially covers the open end of the receptacle, and an open condition, in which the lid is moved so as to provide access to the open end of the receptacle;

a sidewall that is spaced from and movably supported relative to the receptacle, the sidewall being movable between a first position, in which the sidewall is spaced a first distance from the receptacle, and a second position, in which the sidewall is spaced a second distance from the receptacle, the first distance being greater than the second distance; and an actuation mechanism that is configured to effect movement of the lid from the closed condition to the open condition upon movement of the sidewall from the first position to the second position;

wherein the receptacle comprises a camming surface and the lid comprises a cam surface that is position between the camming surface and the sidewall; and wherein, when the sidewall is moved from the first position to the second position, the cam surface engages with the camming surface to pivot the lid from the closed condition to the open condition.

2. The container according to claim 1, wherein the movement of the sidewall from the first position to the second position comprises tilting the sidewall towards the receptacle.

3. The container according to claim 1, further comprising a lid support member that projects inwardly from the sidewall;

wherein the sidewall is spaced outwardly from the camming surface;

wherein the lid comprises a lid panel that is pivotably mounted to the lid support member for pivoting about a horizontal axis, the lid panel comprising:

a cover portion that extends from the axis over the open end of the receptacle; and an actuation portion that extends from the axis towards the sidewall;

the lid panel being pivotable about the axis between a closed position, in which the cover portion at least partially covers the open end of the receptacle, and an open position, in which the actuation portion is pivoted upwards from the closed position and the cover portion is pivoted downwards from the closed position to provide access to the open end of the receptacle;

the actuation portion comprising the cam surface that is positioned between the camming surface and the sidewall, the cam surface being configured to engage with the camming surface to pivot the actuation portion of the lid panel upwards, towards the open position, when the sidewall is moved from the first position to the second position.

4. The container according to claim 3, wherein the actuation portion of the lid panel has a weight selected to bias the lid panel towards the closed position; and wherein the sidewall is configured to move from the first position to the second position upon application of a horizontal force to the sidewall.

5. The container according to claim 3, wherein the cam surface is configured to apply a biasing force, provided by the weight of the actuation portion of the lid panel, to the camming surface when the sidewall is at the second position, the biasing force biasing the sidewall towards the first position.

6. The container according to claim 3, wherein the lid panel is pivotable from the closed position to the open position by manually depressing the cover portion of the lid panel, without moving the sidewall from the first position to the second position.

7. The container according to claim 3, wherein the cam surface is configured to be mechanically disengaged from the camming surface when the lid panel is in the open position and the sidewall is at the first position.

8. The container according to claim 3, further comprising a lifting assembly that is operable to lift the actuation portion of the lid panel when activated, to pivot the lid panel from the closed position to the open position, without moving the sidewall from the first position to the second position;

the lifting assembly comprising a lifting body that is configured to engage and lift the actuation portion when the lifting assembly is activated and the sidewall is at the first position.

9. The container according to claim 8, wherein the actuation portion of the lid panel is configured to be mechanically disengaged from the lifting body when the lid panel is in the open position and the lifting assembly is inactive.

10. The container according to claim 8, wherein the lifting assembly further comprises a motor that is configured to move the lifting body upwards when activated.

11. The container according to claim 10, wherein the actuation portion of the lid panel further comprises a battery for powering the motor, the battery having a weight selected to bias the lid panel towards the closed position.

12. The container according to claim 10, wherein the lifting assembly further comprises a gear wheel that is rotatably mounted to the sidewall;

wherein the lifting body comprises a pin that extends from an inwardly facing surface of the gear wheel towards the receptacle;

wherein the motor is configured to rotate the gear wheel when activated;

wherein the pin is configured to lift the actuation portion of the lid panel when the gear wheel is rotated upon activation of the motor;

wherein the motor is mounted to the sidewall;

wherein the gear wheel comprises a worm wheel, and the lifting assembly further comprises a worm screw;

wherein the motor is configured to rotate the worm screw when activated; and wherein the worm screw is configured to engage with the worm wheel to effect rotation of the worm wheel upon activation of the motor.

13. The container according to claim 10, wherein the cover portion of the lid panel comprises a solar panel that is configured to generate electricity from a light source;

wherein the electricity generated by the solar panel is reduced when an object is placed over the cover portion so as to cast shade on the solar panel;

wherein the lifting assembly further comprises a controller that is configured to control activation of the motor; and wherein the controller is configured to activate the motor when the electricity generated by the solar panel is reduced by a predetermined extent.

14. The container according to claim 13, wherein the solar panel is configured to generate electricity for powering the motor.

15. The container according to claim 3, wherein the receptacle comprises a bin, the bin having a bin wall with an outwardly facing surface;

wherein the outwardly facing surface of the bin wall comprises the camming surface;

wherein the container further comprises a shroud with a hollow interior, the bin being disposed within the hollow interior;

wherein the shroud incorporates the sidewall;

wherein the shroud is configured to sit on a support surface, without being rigidly secured to the support surface, so that the shroud is tiltable towards the outwardly facing surface of the bin wall;

wherein the sidewall is at the first position when the shroud is sitting squarely on the support surface, and is at the second position when the shroud is tilted at a predetermined angle towards the outwardly facing surface of the bin wall; and wherein the shroud is removable from the bin.

16. The container according to claim 15, wherein the camming surface is a first camming surface, the bin further comprising a second camming surface, a third camming surface, and a fourth camming surface;

wherein the sidewall is a first sidewall and the lid support member is a first lid support member, the shroud further comprising:

a second sidewall that is spaced outwardly from the second camming surface;

a second lid support member that projects inwardly from the second sidewall;

a third sidewall that is spaced outwardly from the third camming surface;

a third lid support member that projects inwardly from the third sidewall;

a fourth sidewall that is spaced outwardly from the fourth camming surface; and a fourth lid support member that projects inwardly from the fourth sidewall;

wherein the lid panel is a first lid panel, the container further comprising:

a second lid panel that is pivotably mounted to the second lid support member for pivoting about a second horizontal axis, the second lid panel comprising:

a second cover portion that extends from the second axis over the open end of the receptacle; and a second actuation portion that extends from the second axis towards the second sidewall;

the second lid panel being pivotable about the second axis between a closed position, in which the second cover portion at least partially covers the open end of the receptacle, and an open position, in which the second actuation portion is pivoted upwards from the closed position and the second cover portion is pivoted downwards from the closed position to provide access to the open end of the receptacle;

the second actuation portion of the second lid panel having a weight selected to bias the second lid panel towards the closed position;

the second actuation portion comprising a second cam surface that is positioned between the second camming surface and the second sidewall, the second cam surface being configured to engage with the second camming surface to pivot the second actuation portion of the second lid panel upwards, towards the open position, when the shroud is tilted at the predetermined angle towards the second camming surface;

a third lid panel that is pivotably mounted to the third lid support member for pivoting about a third horizontal axis, the third lid panel comprising:

a third cover portion that extends from the third axis over the open end of the receptacle; and a third actuation portion that extends from the third axis towards the third sidewall;

the third lid panel being pivotable about the third axis between a closed position, in which the third cover portion at least partially covers the open end of the receptacle, and an open position, in which the third actuation portion is pivoted upwards from the closed position and the third cover portion is pivoted downwards from the closed position to provide access to the open end of the receptacle;

the third actuation portion of the third lid panel having a weight selected to bias the third lid panel towards the closed position;

the third actuation portion comprising a third cam surface that is positioned between the third camming surface and the third sidewall, the third cam surface being configured to engage with the third camming surface to pivot the third actuation portion of the third lid panel upwards, towards the open position, when the shroud is tilted at the predetermined angle towards the third camming surface; and a fourth lid panel that is pivotably mounted to the fourth lid support member for pivoting about a fourth horizontal axis, the fourth lid panel comprising:

a fourth cover portion that extends from the fourth axis over the open end of the receptacle; and a fourth actuation portion that extends from the fourth axis towards the fourth sidewall;

the fourth lid panel being pivotable about the fourth axis between a closed position, in which the fourth cover portion at least partially covers the open end of the receptacle, and an open position, in which the fourth actuation portion is pivoted upwards from the closed position and the fourth cover portion is pivoted downwards from the closed position to provide access to the open end of the receptacle;

the fourth actuation portion of the fourth lid panel having a weight selected to bias the fourth lid panel towards the closed position;

the fourth actuation portion comprising a fourth cam surface that is positioned between the fourth camming surface and the fourth sidewall, the fourth cam surface being configured to engage with the fourth camming surface to pivot the fourth actuation portion of the fourth lid panel upwards, towards the open position, when the shroud is tilted at the predetermined angle towards the fourth camming surface.

17. The container according to claim 6, wherein the movement of the sidewall from the first position to the second position comprises tilting the sidewall towards the receptacle;

wherein the lid panel is biased towards the closed position;

wherein the sidewall is biased to return to the first position from the second position;

wherein the cam surface is configured to be mechanically disengaged from the camming surface when the lid panel is in the open position and the sidewall is at the first position;

the container further comprising a lifting assembly that is operable to lift the actuation portion of the lid panel when activated, to pivot the lid panel from the closed position to the open position, without moving the sidewall from the first position to the second position;

the lifting assembly comprising a lifting body that is configured to engage and lift the actuation portion when the lifting assembly is activated and the sidewall is at the first position;

wherein the actuation portion of the lid panel is configured to be mechanically disengaged from the lifting body when the lid panel is in the open position and the lifting assembly is inactive; and wherein the lifting assembly further comprises a motor that is configured to move the lifting body upwards when activated.

18. The container according to claim 17, wherein the actuation portion of the lid panel has a weight selected to bias the lid panel towards the closed position;

wherein the receptacle comprises a bin, the bin having a bin wall with an outwardly facing surface;

wherein the outwardly facing surface of the bin wall comprises the camming surface;

wherein the container further comprises a shroud with a hollow interior, the bin being disposed within the hollow interior;

wherein the shroud incorporates the sidewall;

wherein the shroud is configured to sit on a support surface, without being rigidly secured to the support surface, so that the shroud is tiltable towards the outwardly facing surface of the bin wall;

wherein the sidewall is at the first position when the shroud is sitting squarely on the support surface, and is at the second position when the shroud is tilted at a predetermined angle towards the outwardly facing surface of the bin wall.

19. The container according to claim 18, wherein the container is a waste container.

20. The container according to claim 2, wherein the sidewall is a first sidewall, the container further comprising a second sidewall, a third sidewall, and a fourth sidewall;

wherein the first sidewall, the second sidewall, the third sidewall, and the fourth sidewall together form a shroud that encircles the receptacle, with the third sidewall being positioned at an opposite side of the shroud from the first sidewall;

wherein the first sidewall, the second sidewall, the third sidewall, and the fourth sidewall each have a bottom edge that is configured to sit squarely on a support surface adjacent to the receptacle when the first sidewall is at the first position;

wherein the movement of the first sidewall from the first position to the second position comprises pivoting the shroud about a horizontal pivot axis defined by the bottom edge of the third sidewall; and wherein the bottom edge of the first sidewall is spaced from the support surface and the bottom edge of the third sidewall is in contact with the support surface when the first sidewall is at the second position.

* * * * *